US012490819B1

(12) United States Patent
Vogueman et al.

(10) Patent No.: US 12,490,819 B1
(45) Date of Patent: Dec. 9, 2025

(54) SMALL OBJECT STORAGE APPARATUS

(71) Applicant: Little Nest Solutions LLC, Lakewood, CO (US)

(72) Inventors: Jon V. Vogueman, Lakewood, CO (US); Daniel A. Guin, Denver, CO (US); Dadny J. Vogueman, Lakewood, CO (US)

(73) Assignee: Little Nest Solutions LLC, Lakewood, CO (US)

( * ) Notice: Subject to any disclaimer, the term of this patent is extended or adjusted under 35 U.S.C. 154(b) by 0 days.

(21) Appl. No.: 19/235,479

(22) Filed: Jun. 11, 2025

(51) Int. Cl.

| | |
|---|---|
| ***B65D 83/04*** | (2006.01) |
| ***A45C 11/24*** | (2006.01) |
| ***A45C 13/00*** | (2006.01) |
| ***A45C 13/02*** | (2006.01) |
| ***A45C 13/10*** | (2006.01) |
| *A45C 11/00* | (2006.01) |

(52) U.S. Cl.
CPC ..... *A45C 11/24* (2013.01); *A45C 13/001* (2013.01); *A45C 13/02* (2013.01); *A45C 13/1069* (2013.01); *B65D 83/0454* (2013.01); *A45C 2011/007* (2013.01); *B65D 2583/0459* (2013.01)

(58) Field of Classification Search
CPC ..... A45C 11/24; A45C 13/001; A45C 13/02; A45C 13/1069; A45C 2011/007; B65D 83/0454; B65D 83/0445; B65D 2583/0459
USPC ..... 206/538, 533
See application file for complete search history.

(56) References Cited

U.S. PATENT DOCUMENTS

| | | | | |
|---|---|---|---|---|
| 2,227,167 | A | 12/1940 | Warren | |
| 3,298,569 | A | 1/1967 | Weitzman | |
| 3,394,796 | A | 7/1968 | Jensen | |
| 3,437,236 | A | 4/1969 | Huck | |
| 3,633,792 | A | 1/1972 | Steigerwald | |
| 3,921,806 | A | 11/1975 | Wawracz | |
| 4,124,143 | A | 11/1978 | Thomas | |
| 4,399,914 | A * | 8/1983 | Damratowski | B65D 83/0463 206/533 |
| 4,572,403 | A | 2/1986 | Benaroya | |
| 4,785,969 | A | 11/1988 | McLaughlin | |
| 5,176,285 | A | 1/1993 | Shaw | |
| 5,322,166 | A * | 6/1994 | Crowther | B65D 83/0454 221/277 |
| 5,477,981 | A | 12/1995 | Heyl et al. | |
| 5,887,719 | A * | 3/1999 | Edwards | B65D 83/0454 206/534 |
| 6,098,835 | A | 8/2000 | DeJonge | |
| 6,193,103 | B1 | 2/2001 | Clarijs | |
| 6,325,241 | B1 * | 12/2001 | Garde | B65D 83/0454 221/87 |

(Continued)

FOREIGN PATENT DOCUMENTS

| | | | |
|---|---|---|---|
| AU | 2022203194 | B2 | 6/2022 |
| CN | 104071435 | A | 10/2014 |

(Continued)

*Primary Examiner* — Jacob K Ackun
(74) *Attorney, Agent, or Firm* — Stephen B. Katsaros; Patent Engineering, LLC

(57) ABSTRACT

The present disclosure provides a storage apparatus to secure and provide access to objects. The apparatus includes a base with pockets and a cover removably adjoined to the base. The cover has an aperture. In an accessing condition, the cover rotates to align the aperture with a desired pocket to allow access to the object for the user.

22 Claims, 31 Drawing Sheets

(56) References Cited

U.S. PATENT DOCUMENTS

| | | | | |
|---|---|---|---|---|
| 6,394,308 | B1 | 5/2002 | Yuyama et al. | |
| 6,488,176 | B2 | 12/2002 | Garrant et al. | |
| 6,769,567 | B2 | 8/2004 | Gauthier et al. | |
| 7,100,793 | B2 | 9/2006 | Baum | |
| 7,104,417 | B2 | 9/2006 | Hilliard | |
| 7,128,213 | B2 * | 10/2006 | Tung | A61J 7/04 220/524 |
| 7,159,720 | B2 | 1/2007 | Pearson | |
| 8,967,378 | B2 * | 3/2015 | Schapiro | A61Q 11/00 221/87 |
| 9,209,442 | B1 | 12/2015 | Schiffmiller et al. | |
| 9,218,458 | B2 | 12/2015 | Baarman et al. | |
| 10,546,100 | B2 | 1/2020 | Zetterström | |
| 10,555,873 | B2 | 2/2020 | Poirier et al. | |
| 10,945,924 | B2 | 3/2021 | Gross | |
| 11,053,065 | B2 | 7/2021 | Brady et al. | |
| 11,382,834 | B2 | 7/2022 | Risch | |
| 11,798,669 | B2 | 10/2023 | Rosomoff et al. | |
| 2005/0205595 | A1 | 9/2005 | Lepke et al. | |
| 2005/0218152 | A1 | 10/2005 | Simon | |
| 2015/0090733 | A1 | 4/2015 | Park | |
| 2016/0008226 | A1 | 1/2016 | Hines et al. | |
| 2016/0022541 | A1 | 1/2016 | Dalal et al. | |
| 2018/0186482 | A1 | 7/2018 | Mikeska | |
| 2019/0177047 | A1 | 6/2019 | Doyle et al. | |
| 2021/0347541 | A1 | 11/2021 | Linton et al. | |

FOREIGN PATENT DOCUMENTS

| | | | |
|---|---|---|---|
| CN | 110996880 | A | 4/2020 |
| EP | 3669852 | A1 | 6/2020 |
| EP | 3784198 | B1 | 3/2021 |
| GB | 1277163 | A | 6/1972 |
| WO | 2013120029 | A1 | 8/2013 |
| WO | 2019203953 | A1 | 10/2019 |
| WO | 2022010363 | A1 | 1/2022 |

* cited by examiner

SMALL OBJECT STORAGE APPARATUS

TECHNICAL FIELD

The present disclosure relates to a small object storage apparatus, particularly to a storage apparatus with a rotatable cover for securely storing and providing selective access to small objects.

BACKGROUND

Personal item management has become increasingly relevant in daily life. Portable storage solutions have evolved to meet the needs of individuals carrying various small consumables such as supplements, breath mints, and vitamins. These solutions help organize contents, offer reminders, and support consistent usage. As routines become more complex, there is growing interest in enhancing the functionality, security, and user-friendliness of storage and access solutions for everyday personal items.

SUMMARY

The present disclosure relates to a storage apparatus for securely storing objects, such as but not limited to small objects, including supplements, breath mints, vitamins, and the like. The disclosure provides a compact, portable device with multiple pockets for organizing objects, a cover rotatably coupled to a base for accessing individual pockets, and a magnetic coupling system for securely attaching the cover to the base.

In some aspects, the techniques described herein relate to a storage apparatus to store a plurality of an object, the apparatus including: a base including: a base bottom; a base top oppositely disposed to the base bottom; a plurality of pockets arranged in a circular pattern about a center of the base on the base top; and a base coupling assembly adjoined to the center of the base on the base top; a cover removably adjoined to the base, the cover including: a cover top; an aperture formed on the cover top; a cover bottom oppositely disposed to the cover top; and a cover coupling assembly adjoining the cover bottom; a filling condition, wherein: the cover is decoupled from the base; and the plurality of pockets are configured to receive the plurality of the object; and an accessing condition, wherein: the cover is rotatably adjoined to the base; the cover coupling assembly is coupled to the base coupling assembly; and the cover is rotatable to align the aperture to a desired pocket from the plurality of pockets to access the object from the desired pocket.

In some aspects, the techniques described herein relate to a method of storing a plurality of objects in a storage apparatus including a base and a cover, the method including: providing a storage apparatus including: a base including a base top, a base bottom, and a plurality of pockets arranged in a circular pattern about a center of the base on the base top; a base coupling assembly disposed at the center of the base on the base top; and a cover including a cover top, an aperture formed on the cover top, a cover bottom oppositely disposed to the cover top, and a cover coupling assembly disposed on the cover bottom; separating the cover from the base to define a filling condition; inserting one or more of the plurality of objects into the plurality of pockets in the base; rotatably coupling the cover to the base such that the cover coupling assembly engages the base coupling assembly to define an accessing condition; and rotating the cover relative to the base to align the aperture with a selected pocket from the plurality of pockets, thereby providing access to an object stored therein.

In some aspects, the techniques described herein relate to an object storage assembly, including: a first object storage apparatus, including: a first base including: a first base bottom; a first base top oppositely disposed to the first base bottom; a plurality of pockets arranged in a circular pattern about a first center of the first base on the first base top; a first base coupling housing formed on the first center; and a first base coupling assembly accommodated in the first base coupling housing; and a first cover removably adjoined to the first base, the first cover including: a first cover top; a first cover bottom oppositely disposed to the first cover top; a first cover coupling housing formed on a center of the first cover bottom; and a first cover coupling assembly accommodated in the first cover coupling housing; a second object storage apparatus, including: a second base including: a second base bottom; a second base top oppositely disposed to the first base bottom; a plurality of pockets arranged in a circular pattern about a second center of the second base on the second base top; a second base coupling housing formed on the second center; and a second base coupling assembly accommodated in the second base coupling housing; and a second cover removably adjoined to the second base, the second cover including: a second cover top; a second cover bottom oppositely disposed to the second cover top; a second cover coupling housing formed on a center of the second cover bottom; a second cover coupling housing formed on a center of the second cover bottom; and a second cover coupling assembly accommodated in the second cover coupling housing; an accessing condition, wherein: the first object storage apparatus is separated from the second object storage apparatus; and a traveling condition, wherein: the first object storage apparatus is adjoined to the second object storage apparatus with: the first base coupling assembly adjoined to the second cover coupling assembly, or the first cover coupling assembly adjoined to the second base coupling assembly.

Further areas of applicability of the present disclosure will become apparent from the detailed description provided hereinafter. It should be understood that the detailed description and specific examples, while indicating various configurations, are intended for purposes of illustration only and are not necessarily intended to limit the scope of the disclosure.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, together with the detailed description, explain the principles of the system. No attempt is made to show structural details in more detail than necessary for a fundamental understanding of the system and the various ways in which it is practiced. The following figures of the drawing include.

Figure 1:
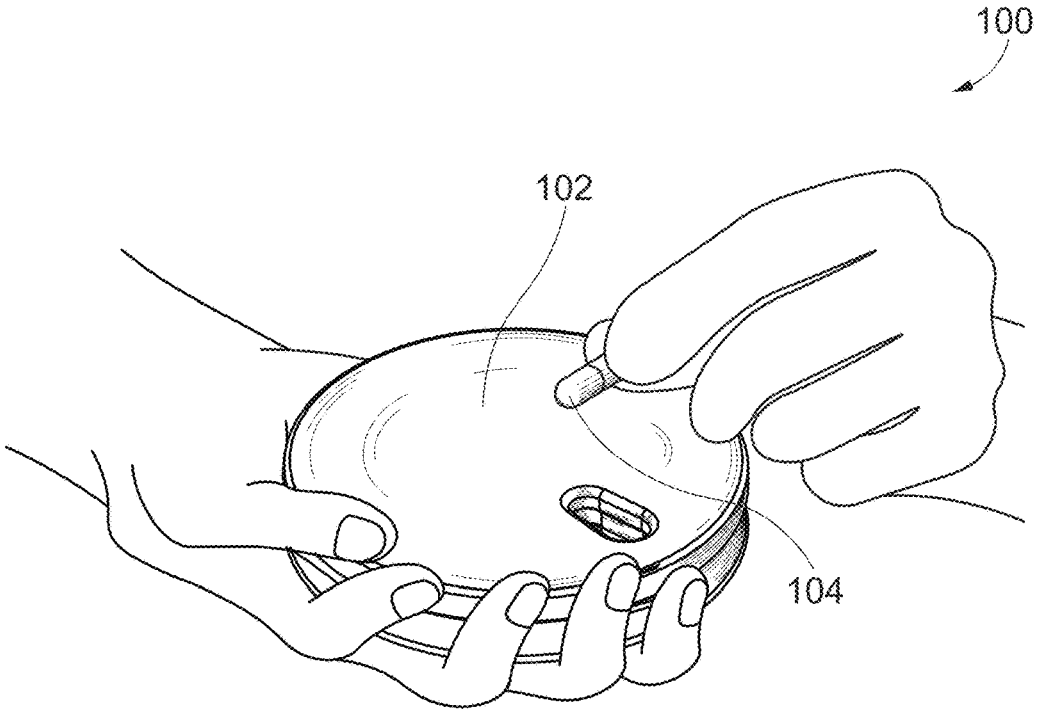
FIG. 1 illustrates a perspective view of a storage apparatus in a filling condition.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered exemplary only, with the true scope and spirit being indicated by the following claims.

Managing small personal consumables presents ongoing challenges for individuals who rely on regular use of objects such as supplements, breath mints, or vitamins. Existing portable storage solutions often lack sufficient portability, discretion, and protection against moisture or contamination. Many users face difficulties with bulky or poorly designed containers that are inconvenient to carry and fail to organize multiple objects effectively. Additionally, conventional containers often lack reliable sealing mechanisms, leaving their contents vulnerable to environmental factors such as humidity or water seepage, which can compromise their quality or usability.

To improve existing storage solutions, a storage apparatus for storing and allowing access to objects, such as small objects e.g., supplements, vitamins, and the like, is disclosed. The storage apparatus may include a base and a removably adjoined cover. The base may include multiple pockets arranged in a circular pattern to accommodate objects. The cover may feature an aperture to allow user to access the objects stored therein. Each base and the cover may be provided with a coupling assembly that may allow the cover to rotatably adjoin to the base, enabling selective alignment of the aperture on the cover with desired pockets. The storage apparatus may have a filling condition where the cover is separated from the base for loading objects, and an accessing condition where the cover is attached and rotatable for providing access to objects. In some implementations, a second storage apparatus with a similar configuration may be provided. The two-storage apparatuses may have a traveling condition where they adjoin each other, with coupling assemblies of one container connecting to the other. This modular design may allow for compact storage and transport of multiple storage apparatuses. The present disclosure explains the storage apparatus and configurations, in conjunction with FIGS. 1-58 and alternatives thereof that can be created with support of the present disclosure.

Figure 2:
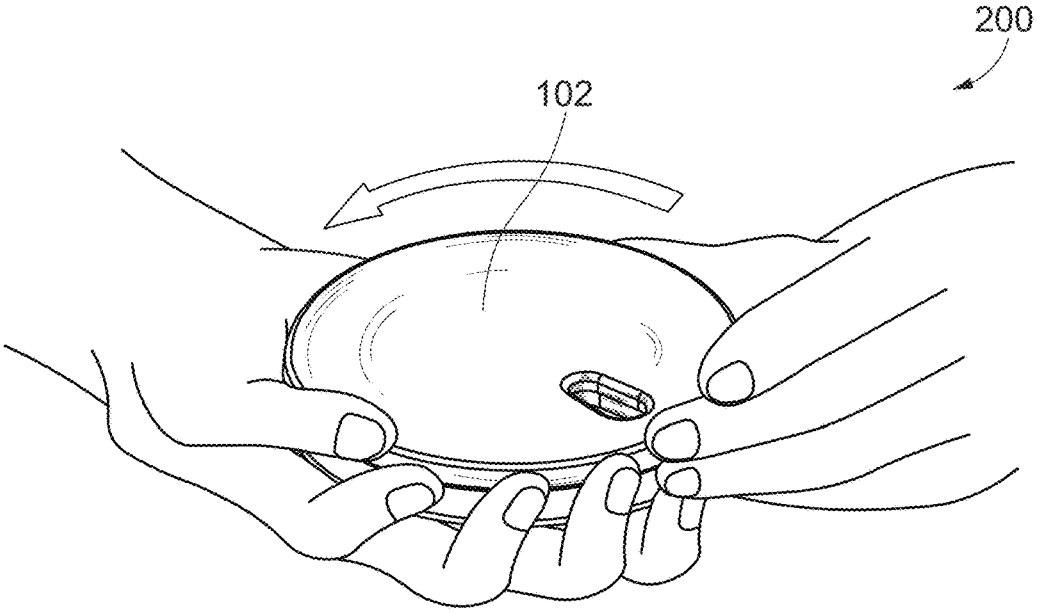
FIG. 2 illustrates a perspective view of the storage apparatus in an accessing condition.

FIG. 1 illustrates a perspective view 100 of a storage apparatus 102 in a filling condition. FIG. 2 illustrates a perspective view 200 of the storage apparatus 102 in an accessing condition. The storage apparatus 102 may be formed of a circular-shaped structure with one or more parts, such as a cover and a base, that may be adjoined and rotatably coupled between an accessing condition and separated in a filling condition. This is explained hereinafter.

Figure 3:
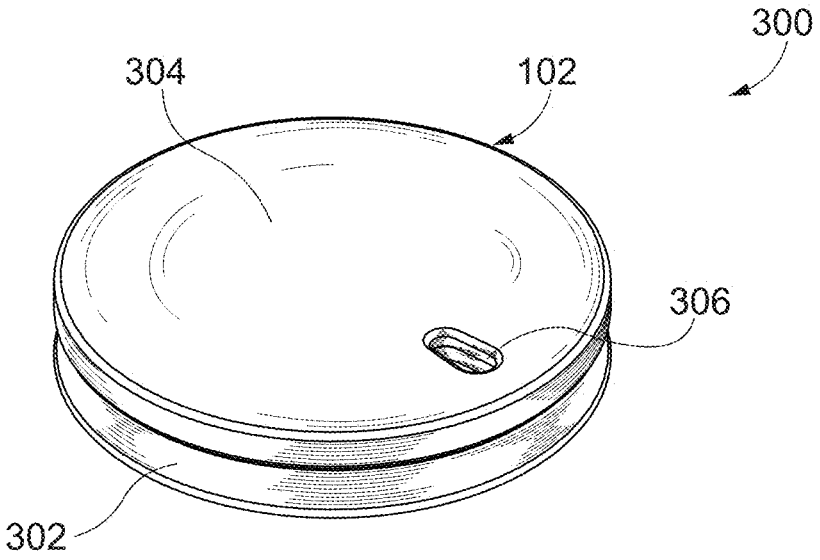
FIG. 3 illustrates a perspective view of a storage apparatus.
Figure 44:
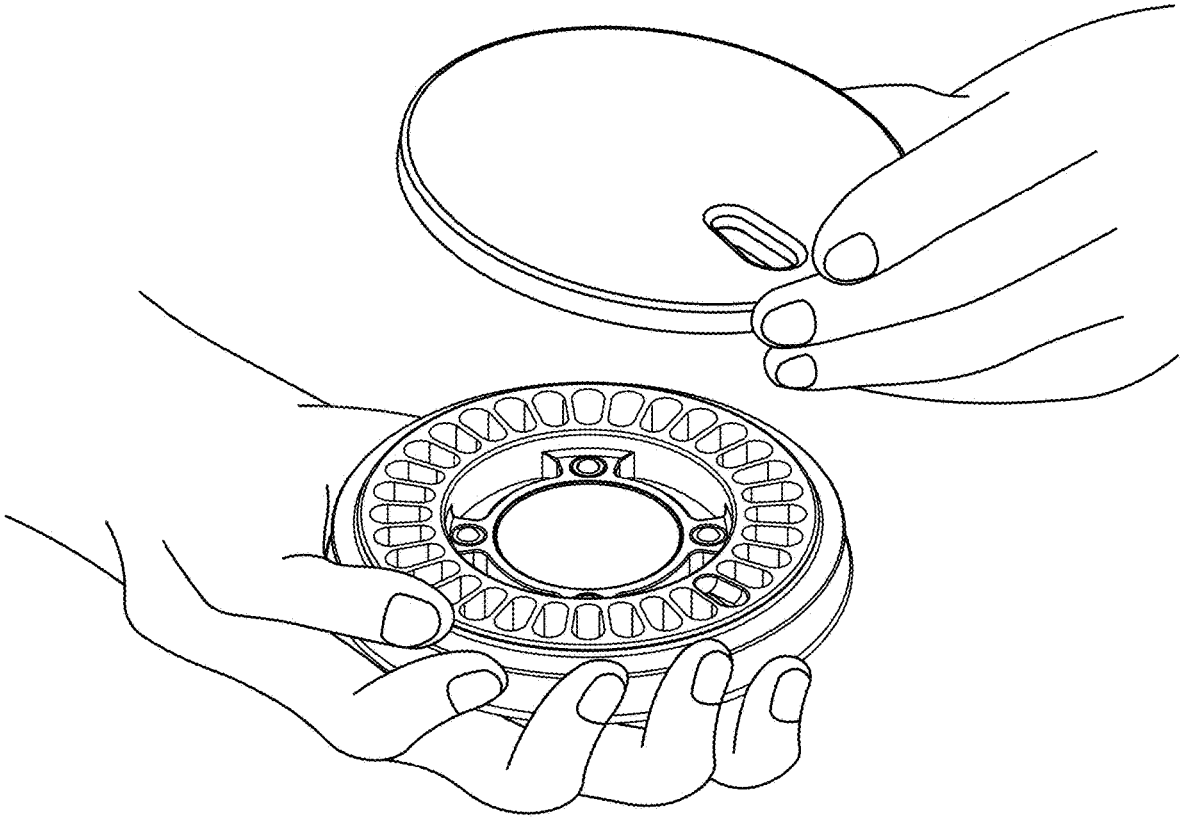
FIGS. 44-46 illustrates various ornamental appearances of an internal assembly of another configuration of the storage apparatus of FIGS. 36-40.

FIG. 3 illustrates a perspective view 300 of a storage apparatus 102. The storage apparatus 102 may include a base 302 and a cover 304. The cover 304 may be rotatably and removably adjoined to the base 302. As such, in some configurations, the cover 304 may be rotatably coupled to the base 302. Further, as explained earlier, the storage apparatus 102 may be configured between the filling condition (FIG. 1) and the accessing condition (FIG. 2). In the accessing condition, the cover 304 may be coupled to the base 302, and the objects may be individually filled into the base 302 via the aperture 306 in the cover 304. Alternatively, the accessing condition may also occur when the cover 304 is separated from the base 302 (as best shown in FIG. 44), allowing the storage apparatus 102 to be filled with objects via an aperture 306 on the cover 304.

With continued reference to FIG. 3, in the accessing condition, the user may rotate the cover 304 to adjust the aperture on the cover 304 to a desired pocket 410 on the base 302 to provide access to an object 104 from the storage apparatus 102. The cover 304 and the base 302 are explained hereinafter.

Figure 4:
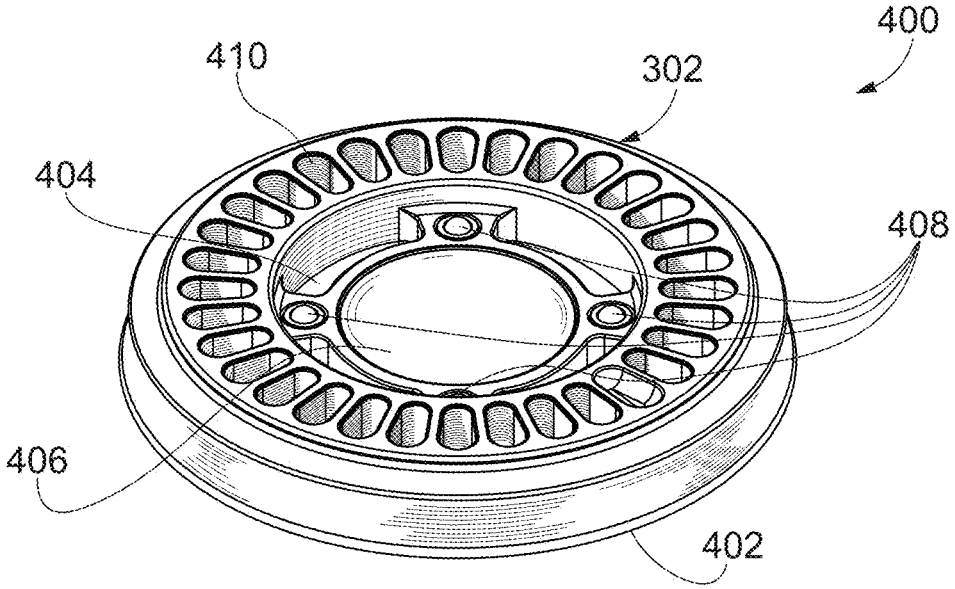
FIG. 4 illustrates a perspective view of a base.

FIG. 4 illustrates a perspective view 400 of one configuration of the base 302. The base 302 may include a base bottom 402 and a base top 404. The base top 404 may be oppositely disposed to the base bottom 402. Further, the base 302 may include a base coupling assembly 406 at the center of the base 302 on the base top 404. Furthermore, the base 302 may include a plurality of pockets 410 arranged in a circular pattern on the base top 404. Further, the base 302 may include one or more of a base indexing feature 408 positioned between the plurality of pockets 410 and the base coupling assembly 406.

The base coupling assembly 406 may include a component or group of components configured to facilitate removable attachment between the base 302 and cover 304 (FIG. 3) of the storage apparatus 102. The base coupling assembly 406 may include magnetic elements, mechanical fasteners, or a combination thereof, positioned at or near the center of the base 302. The base coupling assembly 406 may work in conjunction with a corresponding cover coupling assembly to create a secure yet separable connection, allowing for rotation of the cover 304 relative to the base 302 while maintaining proper alignment and stability during use.

The base indexing feature 408 may include one or more features designed to provide tactile and/or audible feedback during the rotation of the cover 304 relative to the base 302. In some implementations, the base indexing feature 408 may include a spring-loaded ball, a series of detents, or other mechanical elements that engage with corresponding features on the cover 304 to create discrete rotational positions. The base indexing feature 408 may facilitate precise alignment between the aperture 306 and the individual pockets 410, potentially improving ease of use and accuracy in accessing objects therein.

With continued reference to FIG. 3, the plurality of pockets 410 may secure and accommodate objects. Further, the plurality of pockets 410 may include a set of compartments or recesses formed within the base 302 of the storage apparatus 102. The plurality of pockets 410 may be arranged in a circular pattern around the center of the base 302 and may be configured to hold and store individual objects securely. The number of pockets in the plurality of pockets 410 may vary depending on the intended usage duration of the apparatus, potentially ranging from a single pocket to multiple pockets corresponding to daily servings for a week, month, or other periods. Each pocket may be sized and shaped to accommodate different types and sizes of objects and may include features to facilitate easy access and retrieval of the objects when needed or desired.

In an illustrative configuration, the base coupling assembly 406 and the base indexing feature 408 are assembled on one or more features formed on the base top 404. The one or more features formed on the base top 404 may include a bore acting as housing for the base coupling assembly 406 and the base indexing feature 408.

Figure 5:
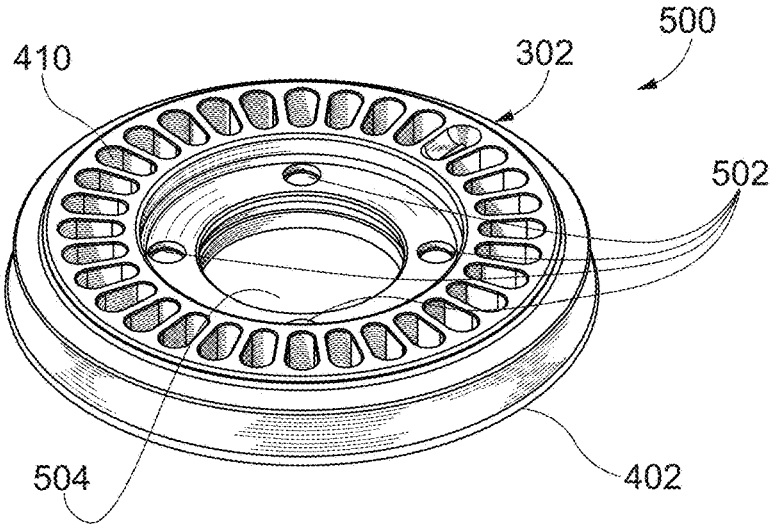
FIG. 5 shows a perspective view of a base.
Figure 6:
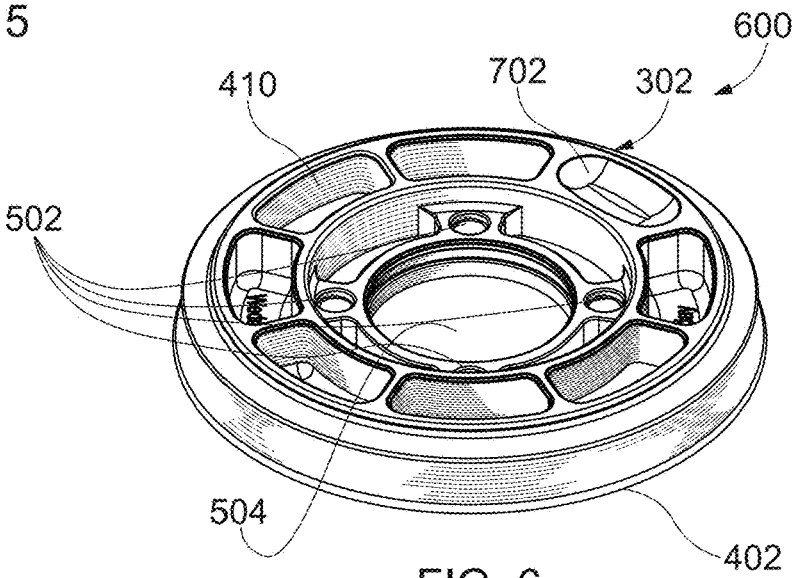
FIG. 6 illustrates a perspective view of another configuration of the base.
Figure 7:
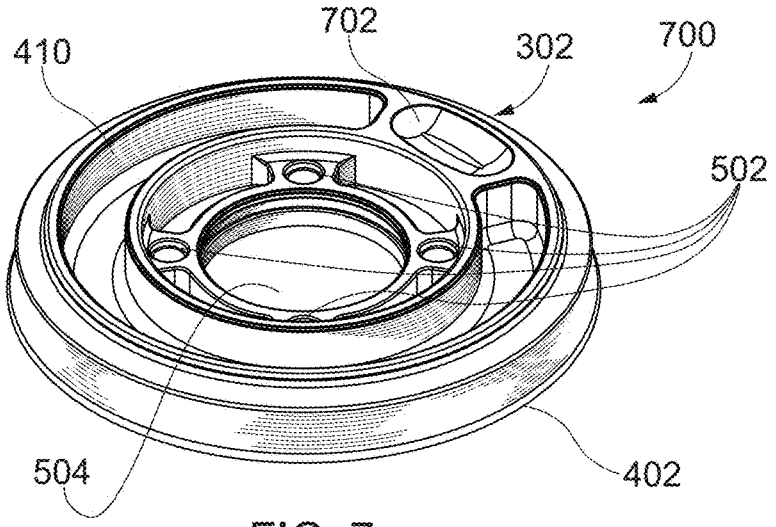
FIG. 7 illustrates a perspective view of another configuration of the base.

FIG. 5 illustrates a perspective view 500 of the base 302. FIG. 6 illustrates a perspective view 600 of another configuration of the base 302. FIG. 7 illustrates a perspective view 700 of another configuration of the base 302.

With reference to FIG. 5, the base 302 may include a base indexing feature housing 502 formed between the plurality of pockets 410. The base indexing feature housing 502 may be configured to accommodate and protect the base indexing feature 408. As such, in some configurations, the base indexing feature housing 502 may be positioned between the base coupling assembly 406 and the plurality of pockets 410. The base indexing feature housing 502 may take various forms, such as a recess, cavity, or raised structure, and may be integrally formed with the base 302 or attached as a separate component. The base indexing feature housing 502 may help maintain the proper alignment and function of the base indexing feature 408 during the operation of the storage apparatus 102.

The base 302 may include a base coupling housing 504 formed at the center of the base 302 to accommodate the base coupling assembly 406 (FIG. 4). In some implementations, the base coupling housing 504 may be a recessed cavity or structure designed to hold and position the base coupling assembly 406 securely. The base coupling housing 504 may have a circular or cylindrical shape that corresponds to the overall circular design of the base 302. The dimensions and depth of the base coupling housing 504 may be configured to allow for proper engagement with the cover coupling assembly 906 when the cover 304 is attached to the base 302. In some cases, the base coupling housing 504 may include features such as alignment guides, retention mechanisms, or sealing elements to enhance the functionality and security of the coupling between the components of the base 302 and the cover 304.

With reference to FIG. 5, the plurality of pockets 410 may include pockets based on usage. For example, referring to FIG. 5, the base 302 may include 30 or 31 pockets corresponding to a month of daily usage.

With reference to FIG. 6, illustrating a perspective view 600 of another configuration of the base 302. This configuration includes similar components shown in FIG. 5, such as the base bottom 402, base indexing feature 408, the plurality of pockets 410, and base coupling housing 504. However, in this configuration, the plurality of pockets 410 may include seven (7) pockets corresponding to a 7-day usage.

With reference to FIG. 7, illustrating a perspective view 700 of another configuration of the base 302. This configuration also includes the base bottom 402, base indexing feature 408, the plurality of pockets 410, and base coupling housing 504. In this configuration, the plurality of pockets 410 may include a single pocket corresponding to a single usage. The different configurations of the base 302, as shown in FIGS. 5-7, may allow for various sizes of the storage apparatus, including mini, small, and larger versions. These different sizes may accommodate various objects and quantities, providing flexibility for different regimens and user preferences.

With continued reference to FIG. 7, in some configurations, the storage apparatus 102 may include a dead spot position 702 that provides additional functionality during operation. For the monthly configuration with 30 or 31 pockets, the apparatus may include 32 total indexed positions, comprising 31 fillable pockets plus 1 dead spot. The dead spot position 702 may allow for a non-exposed pocket configuration after fully loading the apparatus but before its first use, potentially providing enhanced security for the stored. Similarly, the 7-day configuration may include 8 total indexed positions, comprising 7 fillable pockets plus 1 dead spot. The single-servings configuration may include 2 total indexed positions, which may further include 1 fillable pocket plus 1 dead spot. The dead spot position may help ensure that no pocket is exposed when the apparatus is in a secure state, potentially preventing contamination of the objects during transport or storage.

Figure 8:
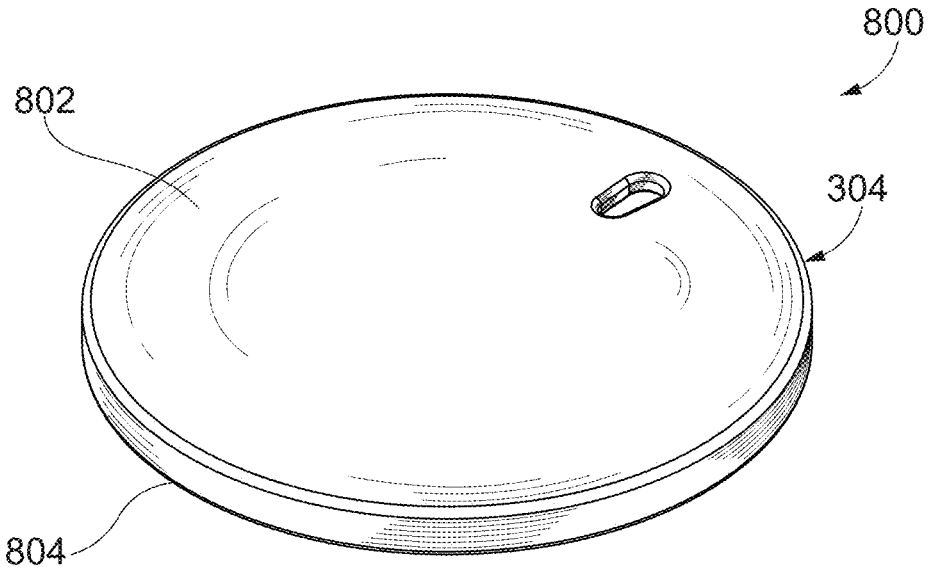
FIG. 8 illustrates a top perspective view of a cover.
Figure 9:
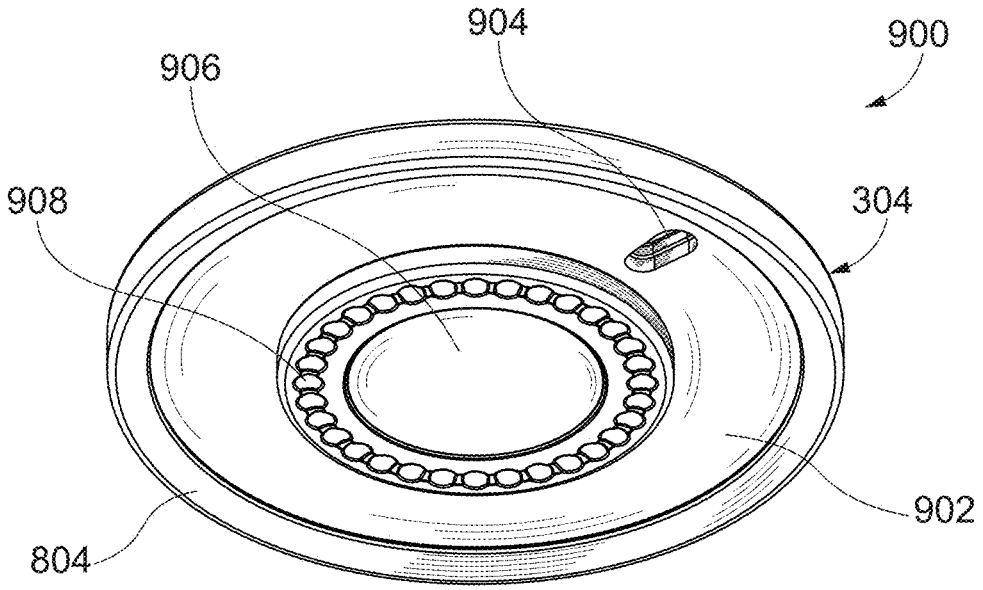
FIG. 9 illustrates a bottom perspective view of the cover.

FIG. 8 illustrates a top perspective view 800 of the cover 304. FIG. 9 illustrates a bottom perspective view 900 of the cover 304. The cover 304 may include a cover top 802 and a cover bottom 804 oppositely disposed from the cover top 802. The cover top 802 may include an exterior surface visible to the user when the storage apparatus 102 is assembled and may feature an aperture for enabling access to the object. The cover bottom 804 may include an interior surface that faces towards the base top 404 of the base 302 when the storage apparatus 102 is in an accessing condition. The cover bottom 804 may include various functional elements such as a coupling assembly, an indexing feature, or optionally a compressible gasket housing to operate and seal the storage apparatus 102 properly.

With reference to FIG. 9, in an illustrative configuration, the cover bottom may include a compressible gasket 902. The compressible gasket 902 may be formed from materials such as, but not limited to, silicone, rubber, or other elastomeric compounds that exhibit resilient properties. In some illustrative configurations, the compressible gasket 902 may feature a specific shape or profile to accommodate the geometry of the surfaces it seals, i.e., the base 302. The compressible gasket 902 may serve multiple functions, including preventing moisture ingress, reducing vibration, or maintaining pressure differentials between sealed compartments. For example, the compressible gasket 902 may be configured to prevent moisture ingress, reduce vibration, or maintain pressure differentials between the base 302 and the cover 304. In certain implementations, the compressible gasket 902 may include surface features or textures to enhance its sealing capabilities or facilitate proper alignment during assembly. In some configurations, the compressible gasket 902 may be removable by the user for cleaning and/or periodic replacement. This feature may allow for apparatus maintenance and improve proper sealing over time.

The compressible gasket 902 may be made of materials selected from, but not limited to, 100% solid silicone with a durometer rating ranging from Shore 10A to 60A. In some cases, the durometer rating may more specifically range from Shore 10A to 30A. The compressible gasket 902 may alternatively be made of closed-cell silicone foam/sponge, TPU, or other material blends such as neoprene combined with BUNA.

In an illustrative configuration, the compressible gasket 902 may include an aperture 904 aligned with the aperture 306 (FIG. 3) of the cover 304. The aperture 904 in the compressible gasket 902 may allow for the passage of objects from the plurality of pockets 410 to the aperture 306 when the cover 304 is rotated to the desired position. In some implementations, the aperture 904 in the compressible gasket 902 may be sized and shaped to correspond with the aperture 306 in the cover 304, ensuring a smooth transition for objects accessing the aperture. Additionally, the aperture 904 may help maintain the integrity of the seal provided by the compressible gasket 902 around the perimeter of the interface of the cover 304 and the base 302. Such configuration may help protect the stored objects from environmental factors, such as moisture or contaminants, when the storage apparatus 102 is in a closed position.

In some configurations, the compressible gasket 902 and the compressible gasket housing 1002 may be optional components of the storage apparatus 102. In addition to (or some configurations with) the compressible gasket configuration, a wear plate (explained in detail in conjunction with FIGS. 12-14) may be incorporated into the cover bottom 804 to provide a durable interface between the cover 304 and the base 302. The wear plate may be formed from materials that offer enhanced resistance to abrasion and repeated contact during rotational movement of the cover 304 relative to the base 302. In implementations utilizing a wear plate, the sealing function may be achieved through precision machining of the mating surfaces between the cover 304 and base 302, potentially creating a close tolerance fit that maintains protection against environmental factors while eliminating the need for a separate gasket component.

In an illustrative configuration, the cover bottom 804 may be configured to accommodate a cover coupling assembly 906. The cover coupling assembly 906 may include magnetic elements, mechanical fasteners, or a combination thereof, designed to engage with a corresponding base coupling assembly 406 and removably couple the base 302 with the cover 304. In some implementations, the cover coupling assembly 906 may allow for rotational movement of the cover 304 relative to the base 302 while maintaining a secure connection. The cover coupling assembly 906 may be accommodated within or integrated into the cover 304, potentially including features that contribute to alignment, indexing, or sealing functions when the cover 304 is adjoined to the base 302.

In an illustrative configuration, a cover coupling assembly 906 may be located at the center of the cover bottom 804. The cover 304 may include a cover coupling housing 1006 formed on the center of the cover bottom 804 to accommodate the cover coupling assembly 906. The cover coupling assembly 906 may include a second magnet assembly disposed in the cover coupling housing 1006.

With reference to FIG. 9, the cover bottom 804 may include cover indexing features 908 arranged around the cover coupling assembly 906. The cover indexing features 908 may include a structural element or mechanism incorporated into the cover 304 that interacts with a corresponding base indexing feature 408 on the base 302 to provide controlled rotational positioning between the cover 304 and the base 302. The cover indexing features 908 may include protrusions, detents, or other geometrical features that engage with complementary elements on the base 302 to create discrete rotational positions. This interaction may produce tactile or audible feedback to indicate the proper alignment of the aperture 306 with specific pockets of the plurality of pockets 410. In some implementations, the cover indexing features 908 may work with the base indexing feature 408 to prevent unintended rotation of the cover 304 relative to the base 302, potentially improving the security and reliability of the storage apparatus 102.

The cover bottom 804 may include various features to accommodate the cover coupling assembly 906, the cover indexing features 908, and the compressible gasket 902 to facilitate proper operation and sealing of the storage apparatus 102. This is explained hereinafter.

Figure 10:
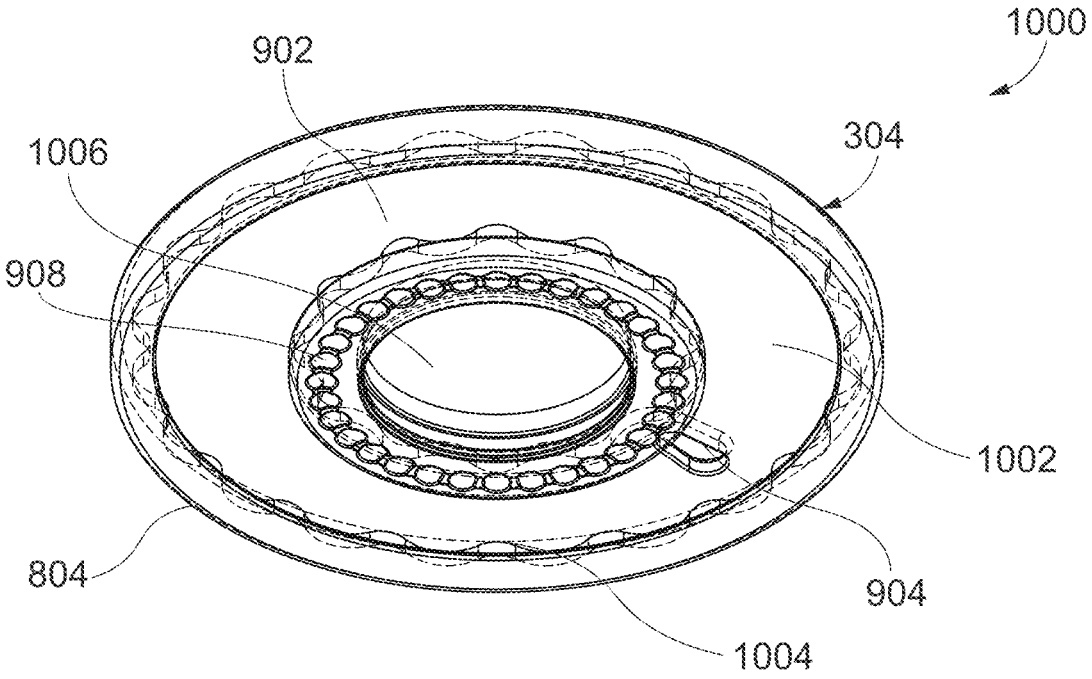
FIG. 10 illustrates a bottom perspective view of another configuration of the cover.
Figure 11:
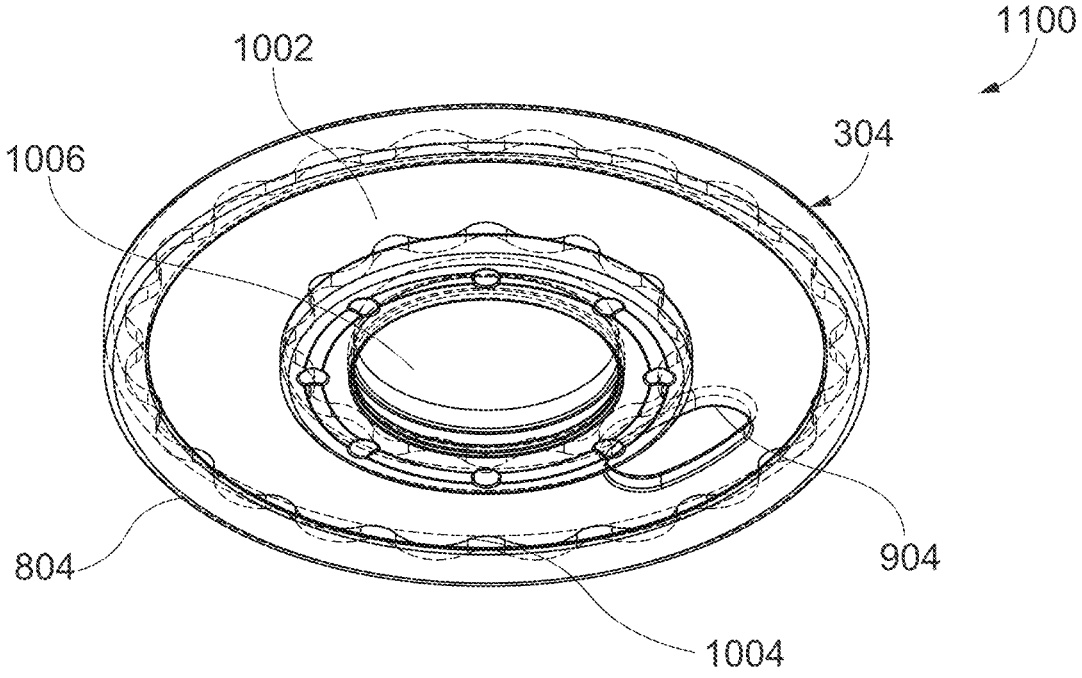
FIG. 11 illustrates another bottom-perspective view of the cover of FIG. 10.

FIG. 10 illustrates a bottom perspective view 1000 of the cover 304. FIG. 11 illustrates another bottom perspective view 1100 of the cover 304. The cover bottom 804 may include a compressible gasket housing 1002 to accommodate the compressible gasket 902 and a cover coupling housing 1006 configured to accommodate a cover coupling assembly 906.

In an illustrative configuration, the compressible gasket housing 1002 may be formed on a cover bottom 804 and configured to accommodate a compressible gasket 902. The compressible gasket housing 1002 may include a recessed area, groove, or channel designed to receive and retain the compressible gasket 902. In some implementations, the compressible gasket housing 1002 may incorporate features such as interlocking patterns or retention mechanisms to help maintain the position of the compressible gasket 902 during use. For example, the compressible gasket 902 may further include an interlocking pattern formed on an inner periphery and an outer periphery. The interlocking pattern may be configured to engage and interlock the corresponding pattern on the cover 304, i.e., the interlocking pattern 1004 on the cover bottom 804, to secure the compressible gasket 902 in the cover bottom 804 during operation. The compressible gasket housing 1002 may be shaped and sized to complement the dimensions and characteristics of the compressible gasket 902, potentially allowing for a secure fit and effective sealing when the storage apparatus 102 is in the accessing configuration.

In an illustrative configuration, the compressible gasket housing 1002 may include an interlocking pattern 1004. The interlocking pattern 1004 may include, but is not limited to, a series of protrusions and recesses, ridges and grooves, or other geometrically corresponding shapes that interlock with the corresponding pattern on the compressible gasket 902 when brought into contact. Such a pattern may align the compressible gasket 902 properly within the compressible gasket housing 1002, thereby preventing unwanted movement or displacement during use and potentially enhancing the sealing properties of the interface of the base 302 and the cover 304. The interlocking pattern 1004 may be formed on the cover bottom 804 using a key-cutting tool. This precision machining process may create a unique pattern of grooves, ridges, or other features corresponding to the interlocking pattern on the compressible gasket 902. Using a key-cutting tool may allow for intricate and precise patterns to be formed, potentially enhancing the secure engagement between the cover 304 and the compressible gasket 902. This method of creating the interlocking pattern may provide a high degree of customization, allowing for different patterns to be implemented across various models or versions of the storage apparatus. The key-cut interlocking pattern may contribute to the overall stability and alignment of the components when the device is assembled, potentially improving its functionality and reliability.

In an illustrative configuration, the cover coupling housing 1006 may be configured to accommodate the cover coupling assembly 906, which may include magnetic components or other fastening mechanisms. This cover coupling housing 1006 may be centrally located on the cover bottom 804 and may provide a secure containment area for the cover coupling assembly 906 that facilitates the removable attachment of the cover 304 to the base 302. The cover coupling housing 1006 may be designed to align with a corresponding base coupling housing 504 when the storage apparatus 102 is assembled, allowing for proper engagement of both the coupling assemblies while permitting rotational movement between the cover 304 and the base 302.

In some configurations, the number of cover indexing features 908 may correspond to the number of pockets in the plurality of pockets 410 in the base 302. For example, referring to FIG. 10, a configuration with 31 pockets may include 31 cover indexing features 908, such as detents, allowing precise alignment of the aperture 306 with each pocket. Similarly, referring to FIG. 11, a 7-day version may incorporate seven (7) indexing detents, while a single-serving configuration may have a single indexing position. This correspondence between indexing features and pockets may enhance the user experience by providing tactile feedback and ensuring accurate positioning for accessing the objects stored therein. The number of indexing features may be customized to match various base 302 configurations, accommodating different regimens and user preferences.

In some configurations, the base 302 and cover 304 may be made of aluminum with a PVD coating applied. The PVD coating may be applied through a multi-step process, which includes nickel plating, chrome plating, and final PVD coating. This coating process may enhance the durability and aesthetic appeal of the storage apparatus 102.

Figure 12:
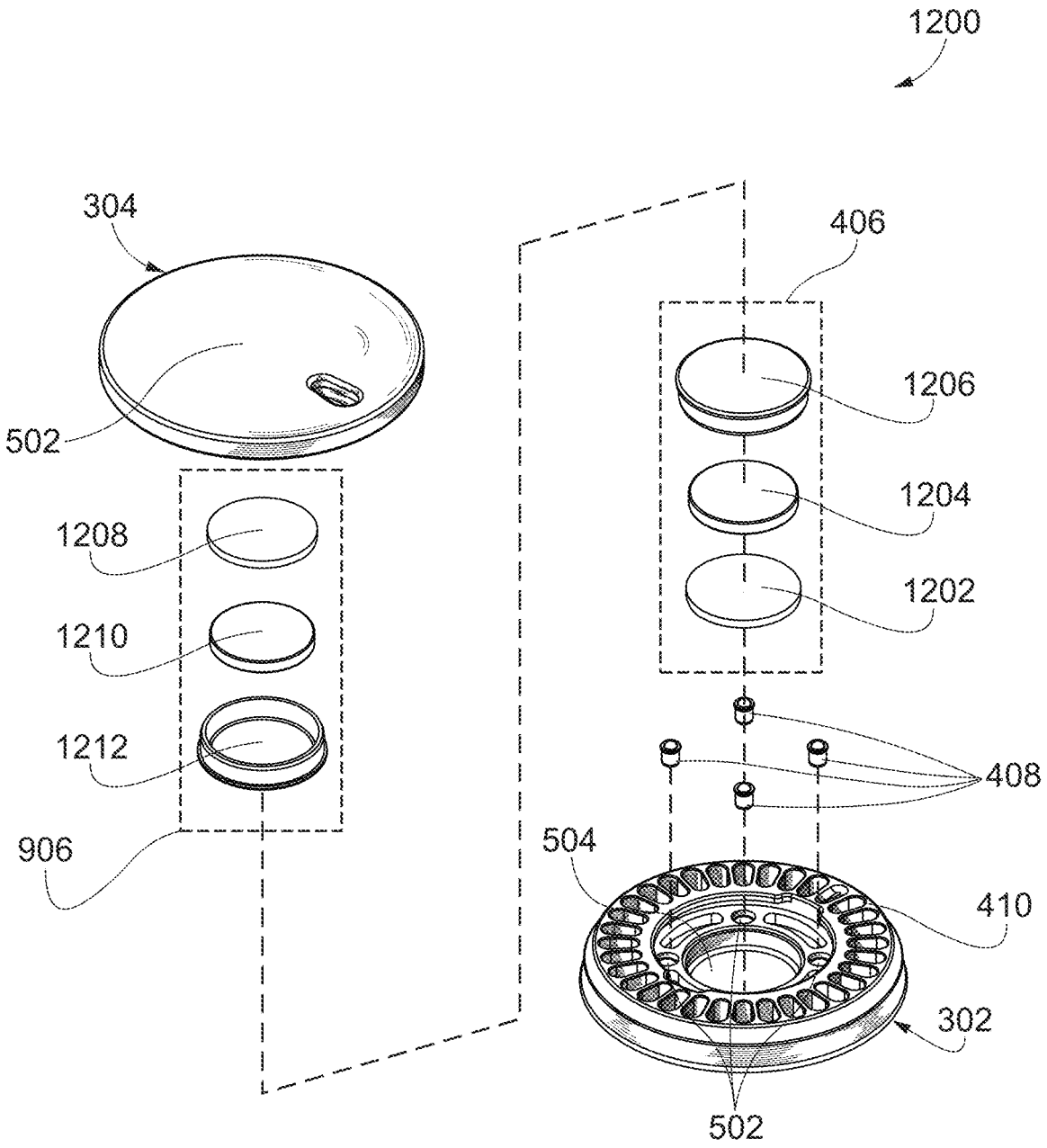
FIG. 12 illustrates an exploded view of a storage apparatus.

FIG. 12 illustrates an exploded view 1200 of the storage apparatus 102, showing the internal components and their assembly arrangement. In some configurations, as explained earlier, the base 302 may include a base coupling assembly 406, and the cover 304 may include the cover coupling assembly 906.

The base coupling assembly 406 may include a first steel plate 1202, a first magnet 1204, and a first wear plate 1206. The first steel plate 1202 may be attached to the first magnet 1204 and assembled with the first wear plate 1206. Further, the first steel plate 1202 and the first magnet 1204, along with the first wear plate 1206, may be affixed to the base coupling housing 504.

With reference to FIG. 12, the cover coupling assembly 906 may include a second steel plate 1208, a second magnet 1210, and a second wear plate 1212. The second steel plate 1208 may be attached to the second magnet 1210 and assembled with the second wear plate 1212. Further, the second steel plate 1208 and the second magnet 1210 along with the second wear plate 1212 may be fixed to the cover coupling housing 1006.

The first wear plate 1206 and the second wear plate 1212 may function as wear plates that provide durable contact surfaces where the majority of the magnet attraction forces will be causing wear during rotational movement between the base 302 and cover 304. Each of the base 302 and cover 304 includes one wear plate that presents an externally exposed flat circular surface of a cup-shaped part. The first wear plate 1206 may provide a wear-resistant interface that distributes rotational forces evenly across the base coupling assembly 406 while protecting the underlying magnetic components. Similarly, the second wear plate 1212 may serve as a protective wear surface, maintaining consistent contact with the cover coupling assembly 906 and helping to preserve the integrity of the magnetic coupling system during repeated rotational cycles. Both wear plates may work together to minimize wear on the magnetic elements and other internal components while ensuring reliable operation over extended periods of use.

The first wear plate 1206 and the second wear plate 1212 may be constructed from stainless steel and feature polished surfaces to provide minimal friction and maximum wear and abrasion resistance. The wear plates may be plated or PVD coated to enhance their durability and surface properties further. The flat circular surfaces of the steel plates stick up beyond the flat surfaces of the base 302 and cover 304 to ensure there is no unintentional wear contact points on the surrounding components. The first wear plate, 1206, and the second wear plate, 1212, may serve multiple purposes. First, they function as wear plates to handle the magnetic attraction forces. Second, they provide a press-fit installation on the exterior side walls, trapping and waterproofing the magnet and steel components beneath fully. Such dual-function design helps maintain the integrity of the magnetic coupling system while providing superior protection against environmental factors.

With continued reference to FIG. 12, the first steel plate 1202 in the base 302 and the second steel plate 1208 in the cover 304 may serve to concentrate and shape the magnetic flux lines. When coupled to the first magnet 1204 and the second magnet 1210, respectively, the first steel plate 1202 and the second steel plate 1208 form a first magnet and second magnet assembly. Further, the first steel plate 1202 and the second steel plate 1208 may act as flux conductors to concentrate and shape the magnetic flux lines from the first magnet 1204 and the second magnet 1210, respectively, potentially enhancing the magnetic coupling strength between the base 302 and cover 304. This arrangement may enable a more efficient use of the magnetic field, possibly resulting in a stronger connection with less magnetic material. Additionally, the first steel plate 1202 and the second steel plate 1208 may help to contain and direct the magnetic field, reducing stray magnetic fields that could interfere with other components or nearby objects. This containment may be particularly beneficial in cases where the storage apparatus 102 is used in proximity to electronic devices or magnetic storage media.

The first magnet 1204 in the base 302 and the second magnet 1210 in the cover 304 may work to provide a secure magnetic coupling between the base 302 and the cover 304. The first magnet 1204 and the second magnet 1210 may be selected to have specific magnetic properties that allow for a strong connection when the cover 304 is placed on the base 302, while still permitting smooth rotational movement. The magnetic force generated by the first magnet 1204 in the base 302 and the second magnet 1210 may be carefully calibrated to provide sufficient holding power to keep the cover 304 securely attached to the base 302 during normal use, yet allow for easy separation when the user intends to open the storage apparatus 102. In some cases, the orientation and polarity of the first magnet 1204 and second magnet 1210 may be arranged to create a self-aligning effect, potentially guiding the cover 304 into the correct position relative to the base 302 during assembly.

The first magnet 1204 and the second magnet 1210 may include, but are not limited to, Neodymium magnets, NdFeB (Neodymium-Iron-Boron), samarium-cobalt magnets, ferrite magnets, and the like, based on a desired implementation. For example, Neodymium magnets, known for their strong magnetic properties, may be employed in the base coupling assembly 406 and the cover coupling assembly 906. These magnets may be selected in different grades, such as N42 or N52, to provide the appropriate magnetic strength for secure closure while allowing easy opening. In some cases, NdFeB (Neodymium-Iron-Boron) magnets may be used due to their high magnetic strength-to-size ratio, enabling a compact design. Samarium-cobalt magnets may be considered for applications requiring temperature resistance, as they maintain their magnetic properties at higher temperatures. Alternatively, ferrite magnets may be utilized in lower-cost versions of the apparatus, offering a balance between performance and affordability. The specific type and grade of the magnet may be selected based on factors such as required coupling strength, temperature resistance, corrosion resistance, and overall cost considerations for different versions of the storage apparatus 102.

With continued reference to FIG. 12, the first wear plate 1206 and the second wear plate 1212 may function to maintain the position of the magnetic components within the base 302 and cover 304, respectively, as explained earlier. The first wear plate 1206 and the second wear plate 1212 may be shaped to fit precisely within their designated housings, i.e., the base coupling housing 504 and the cover coupling housing 1006, potentially providing a snug fit that prevents unwanted movement of the internal components. The first wear plate 1206 and the second wear plate 1212 may also contribute to the overall structural integrity of the assembly, helping to distribute forces evenly and protect the magnetic elements from potential damage. In some cases, the retainers may be designed with features that allow for easy installation during manufacturing while ensuring secure retention during regular use of the storage apparatus 102.

Figure 13:
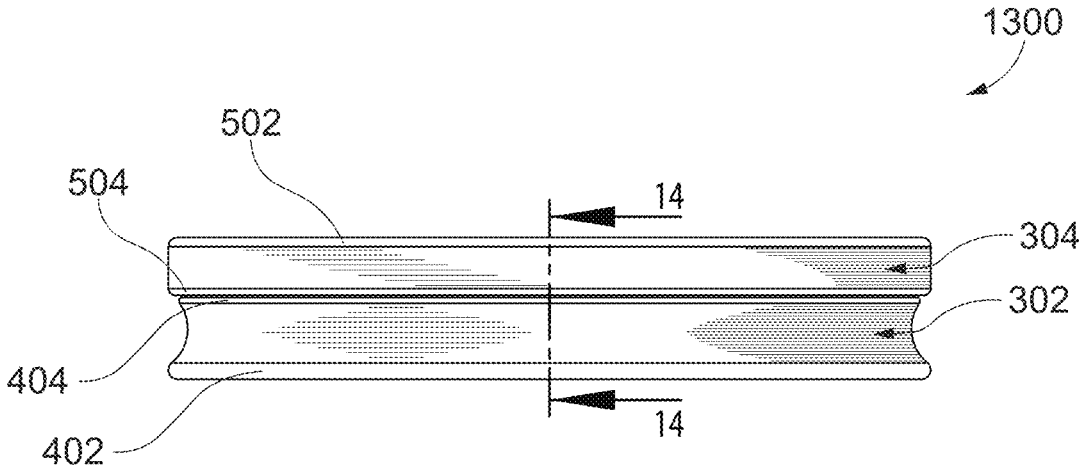
FIG. 13 illustrates a side view of the storage apparatus of FIG. 12.
Figure 14:
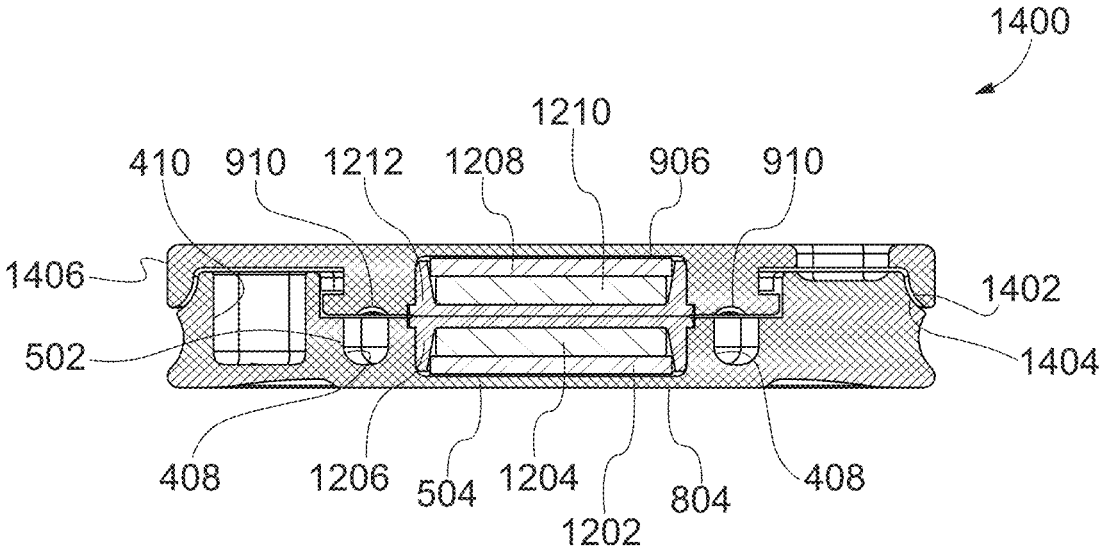
FIG. 14 illustrates a sectional view of the storage apparatus taken across plan 14-14' in FIG. 13.

FIG. 13 illustrates a side view 1300 of the storage apparatus 102. FIG. 14 illustrates a sectional view 1400 of the storage apparatus 102, taken along plan 14-14' along FIG. 13. When assembled, the base coupling assembly 406, i.e., the first steel plate 1202, the first magnet 1204, and the first wear plate 1206 may be secured to the base coupling housing 504. The first wear plate 1206 may secure the first magnet 1204 thereto. Similarly, the cover coupling assembly 906, i.e., the second steel plate 1208, the second magnet 1210, and the second wear plate 1212 may be secured to the cover coupling housing 1006. The second wear plate 1212 may secure the second magnet 1210 thereto.

In some configurations, the base indexing feature 408 may be accommodated within the base indexing feature housing 502 and engage the cover indexing feature 908. As such, in some configurations, the base indexing feature 408 and the cover indexing feature 908 may be interchangeable, i.e., the cover indexing feature 908 may include spring-loaded balls, and the base indexing feature 408 may include the ball detents.

In an illustrative configuration, the base coupling assembly 406 and the cover coupling assembly 906 in the base 302 and cover 304 assemblies may work together to provide magnetic coupling while allowing relative rotation between the base 302 and cover 304. The base indexing feature 408 may provide indexed rotational positions as the cover 304 is turned relative to the base 302, allowing for precise alignment of the aperture 904 with the desired pocket 410.

In an illustrative configuration, with continued reference to FIG. 14, the cover bottom 804 may include an inclined face 1402, and the base top 404 may include an inclined ramp 1404. As the cover 304 is coupled to the base 302, the inclined face 1402 may be configured to interface with the inclined ramp 1404. The inclined face 1402 and the inclined ramp 1404 may be designed with slight interference, creating a snug fit that enhances the tactile feedback when assembling or disassembling the storage apparatus 102.

In some configurations, the storage apparatus 102 may incorporate knurling features to enhance grip and user interaction. The cover 304 may include knurled surfaces along its outer circumference 1406, providing improved handling during rotation. The knurling may be formed as a series of raised ridges, diamond patterns, or other textured surfaces that facilitate secure gripping, particularly when the user's hands may be wet or when fine motor control is limited. In some configurations, the outer circumference 1406 may include a concave or inwardly angled profile, through the top or along a circumference thereof. This shape may complement the similar circumference of the base 302, creating a mirrored effect between both circumference of the base 302 and the cover 304. The concave design of the outer circumference 1406 may facilitate easier separation of the cover 304 from the base 302 when needed. Such a feature may enhance the user experience by providing improved grip and leverage for opening of the storage apparatus 102, potentially benefiting users with limited dexterity or strength. The complementary curves of the outer circumference 1406 of the cover 304 and the circumference of the base 302 may also contribute to the overall aesthetic appeal of the storage apparatus 102 while serving a functional purpose.

In some configurations, higher-end versions of the storage apparatus 102 may be machined from 316 Stainless Steel with an applied direct PVD coating. This material choice may enhance durability and give the apparatus a premium feel. For lower-cost versions, the storage apparatus 102 may use alternative finishes such as raw metal, anodizing, cerakote, powder coat, or baked paint. Such options may allow for a range of price points while maintaining the core functionality of the apparatus. In some cases, ultra-luxury versions of the storage apparatus may incorporate actual gold or silver plating, providing an exclusive and high-end option for users seeking a premium product.

In an illustrative configuration, an object storing assembly may include multiple storage apparatuses that can be coupled together. Such configurations may allow the stacking of a variety of storage apparatuses 102. This is explained hereinafter.

Figure 15:
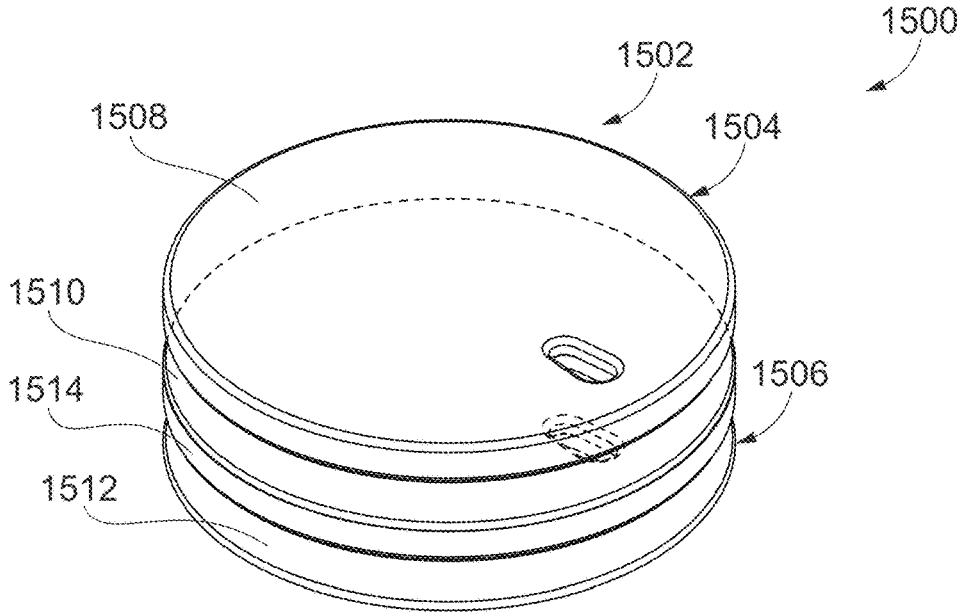
FIG. 15 illustrates a schematic view of an object-storing assembly including a plurality of storage apparatuses in a travel condition.
Figure 16:
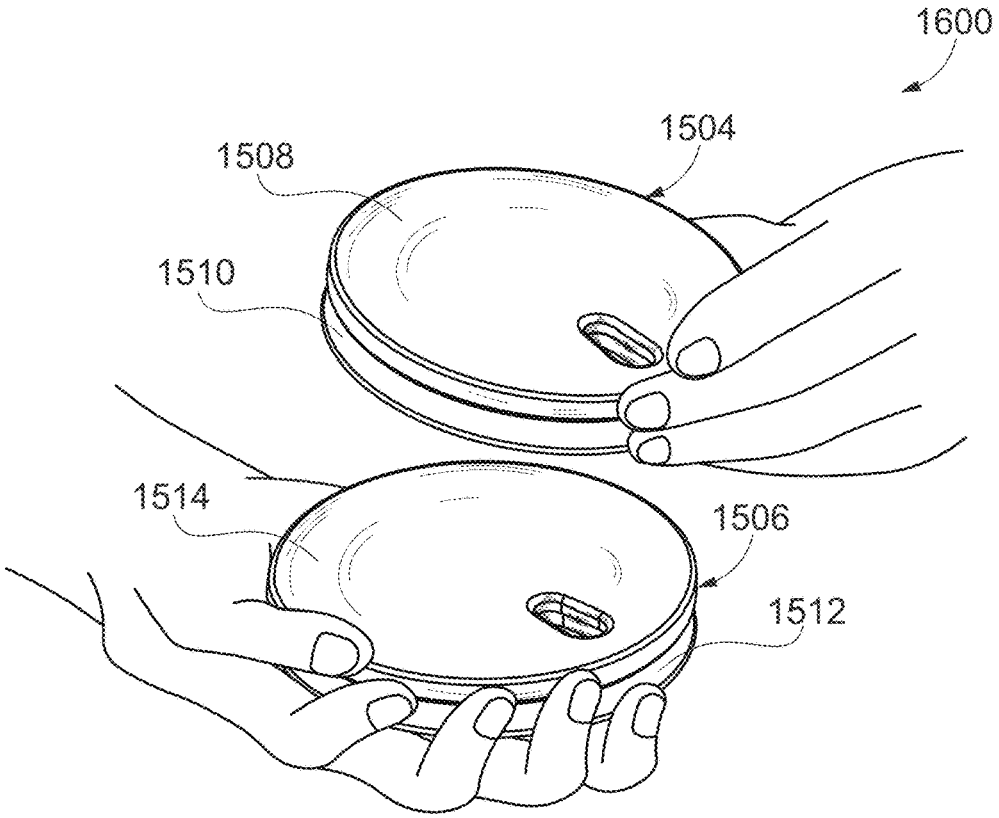
FIG. 16 illustrates a schematic view of a storage apparatus in an accessing condition.

FIG. 15 illustrates a schematic 1500 of an object-storing assembly 1502 in a travel configuration. FIG. 16 illustrates a schematic 1600 of the object-storing assembly 1502 in an accessing configuration. The object-storing assembly 1502 may include a first storage apparatus 1504 and a second storage apparatus 1506. The first storage apparatus 1504 and the second storage apparatus 1506 may be configured to store and provide access to objects securely. In some configurations, the object-storing assembly 1502 may be configured between traveling and accessing conditions.

The first storage apparatus 1504, similar to the storage apparatus 102, may include a first base 1508 and a first cover 1510 removably adjoined to the first base 1508. The first base 1508 may include (not shown in the figures) a first base bottom and a first base top oppositely disposed to the first base bottom. A plurality of pockets (not shown in figures) may be arranged in a circular pattern about the first center of the first base on the first base top. The first base may also include a first base coupling housing (not shown in the figures) formed on the first center and a first base coupling assembly (not shown in the figures) accommodated in the first base coupling housing.

The second storage apparatus 1506, similar to the storage apparatus 102, may include a second base 1512 and a second cover 1514 removably adjoined to the second base 1512. The second base 1512 may include a second base bottom (not shown in figures) and a second base top (not shown in figures) oppositely disposed to the second base bottom. A plurality of pockets (not shown in figures) may be arranged in a circular pattern about the second center of the second base on the second base top. The second base may also include a second base coupling housing formed on the second center and a second base coupling assembly accommodated in the second base coupling housing (not shown in the figures).

With continued reference to FIG. 15, in the traveling condition, the first storage apparatus 1504 may be adjoined to the second storage apparatus 1506. This configuration may be achieved in two ways: the first base coupling assembly of the first storage apparatus 1504 may be adjoined to the cover coupling assembly, or the first cover coupling assembly may be adjoined to the second base coupling assembly. The ability to magnetically couple the first storage apparatus 1504 and the second storage apparatus 1506 may provide convenient storage and transport options for users who require multiple containers. This feature may allow users to keep related objects together or organize servings for different times of day.

To access the object, the object-storing assembly 1502 may be configured to the accessing condition illustrated by FIG. 16. In the accessing condition, the first storage apparatus 1504 may be separated from the second storage apparatus 1506, allowing independent access to the objects stored therein.

Figure 17:
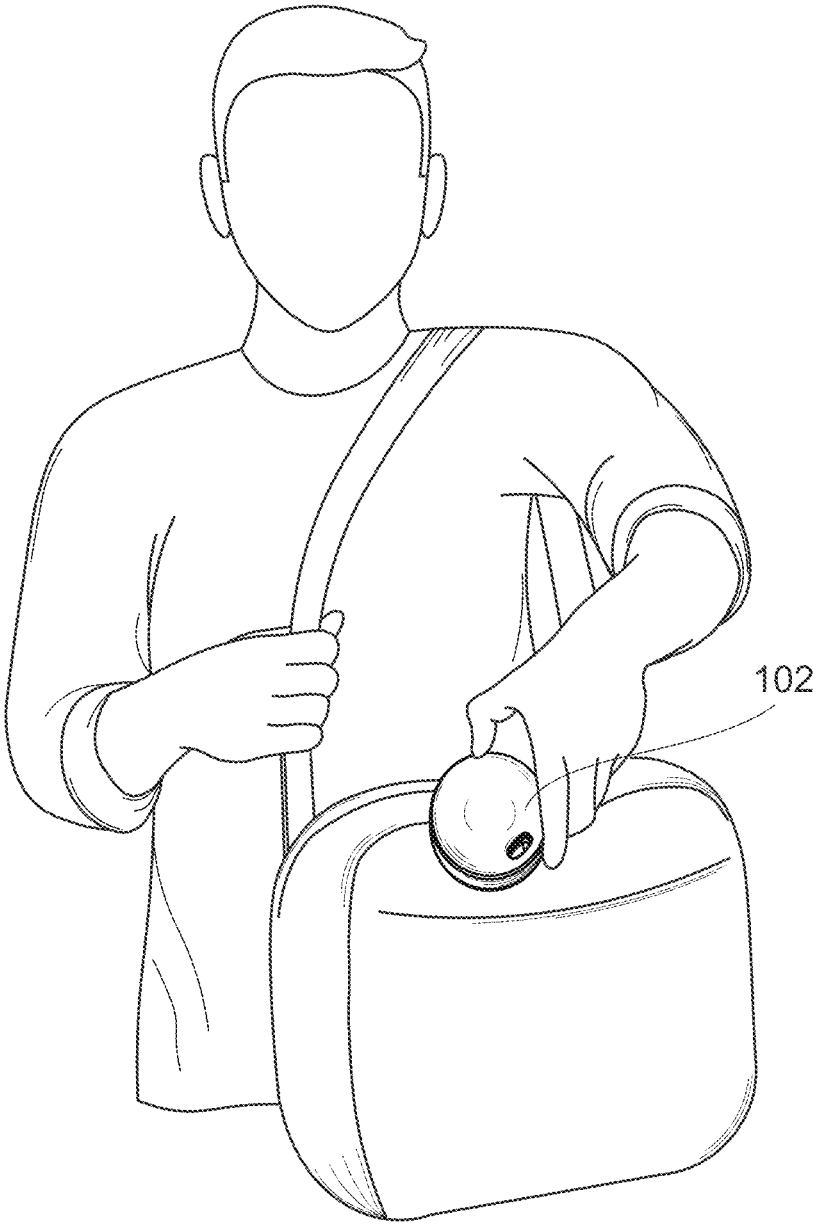
FIG. 17 illustrates a schematic of a user placing the storage apparatus in a bag.
Figure 18:
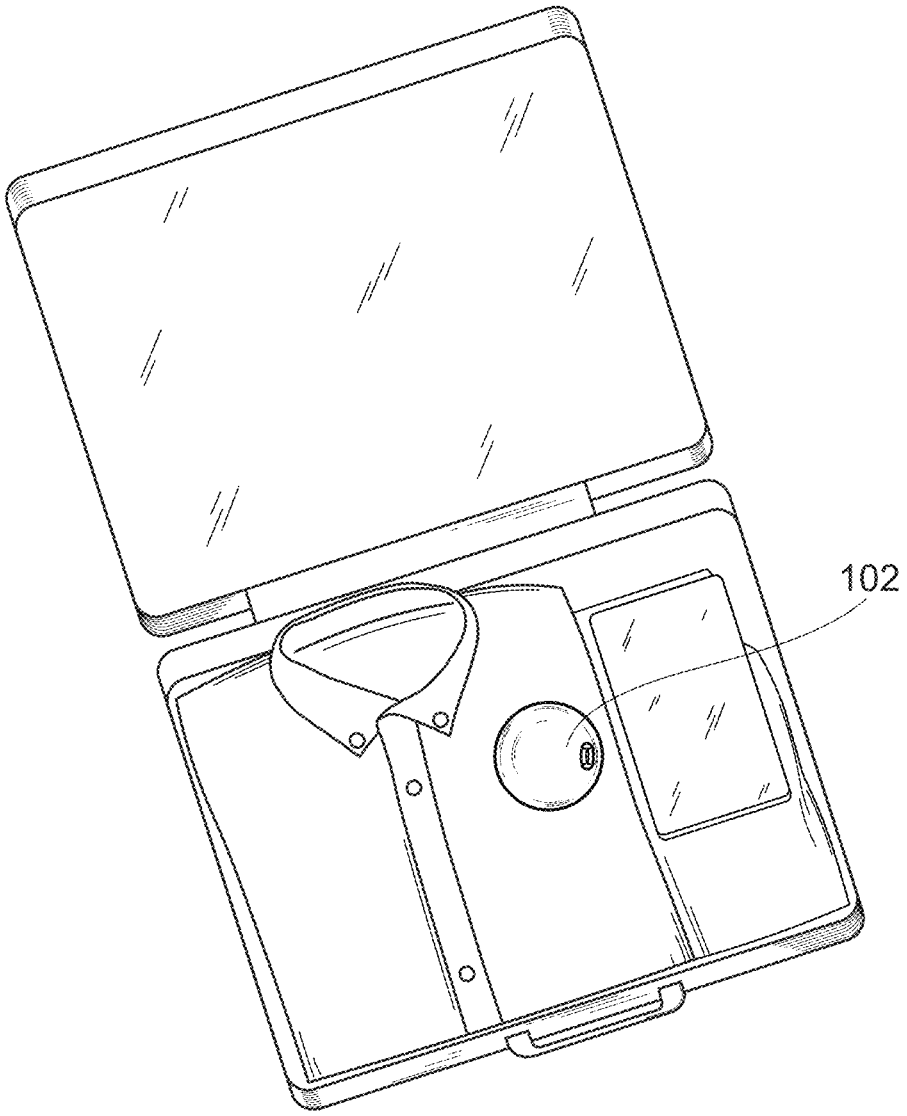
FIG. 18 illustrates a schematic of a user placing the storage apparatus in a briefcase.
Figure 19:
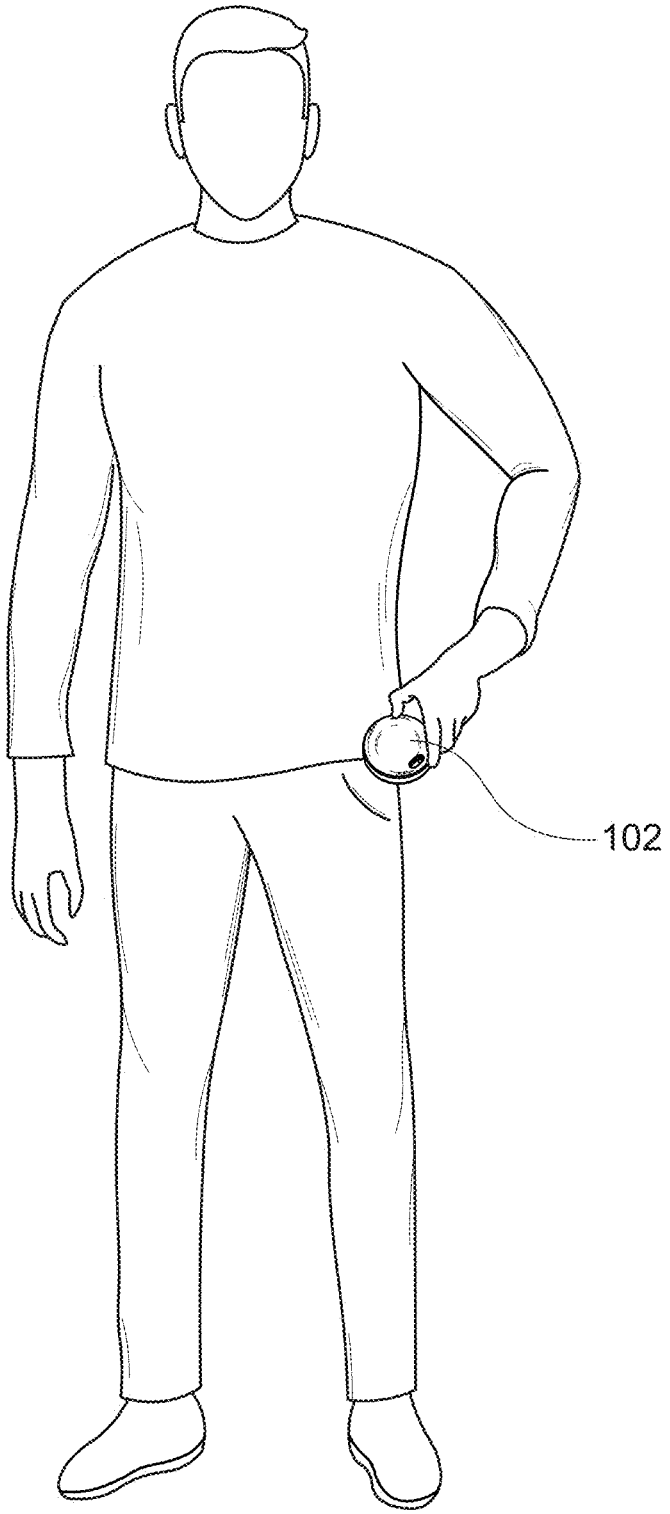
FIG. 19 illustrates a schematic of a user placing the storage apparatus in a pocket.
Figure 20:
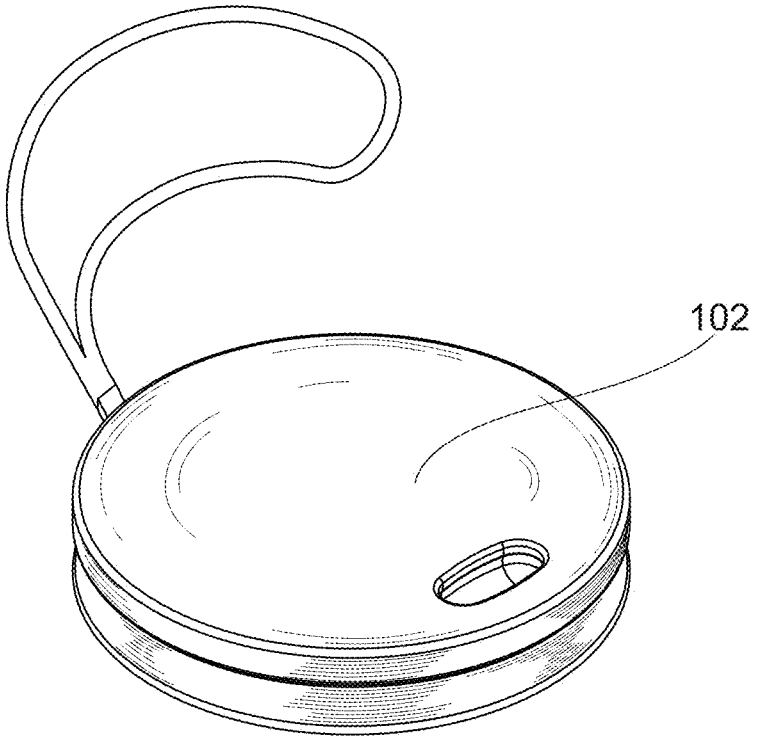
FIG. 20 illustrates a schematic of the storage apparatus assembled with an accessory.
Figure 21:
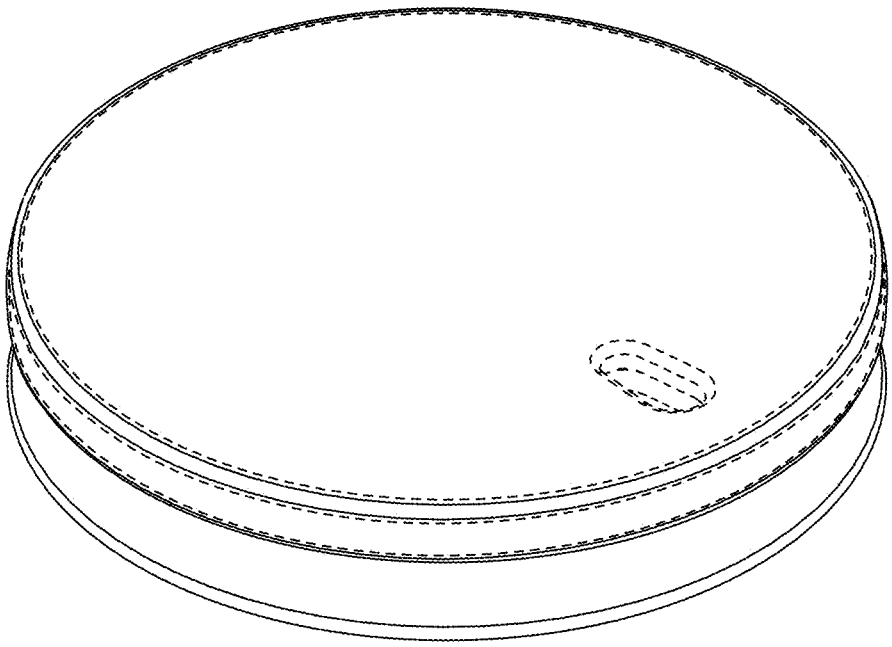
FIGS. 21-24 illustrates various ornamental appearances of the storage apparatus.
Figure 22:
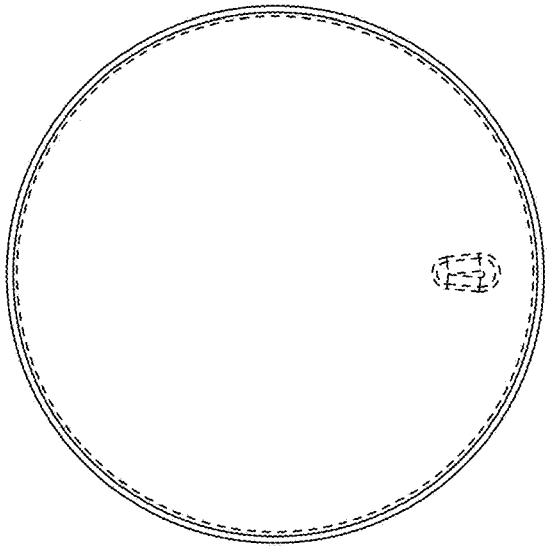
Figure 23:
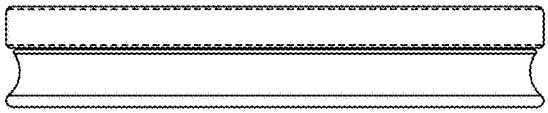
Figure 24:
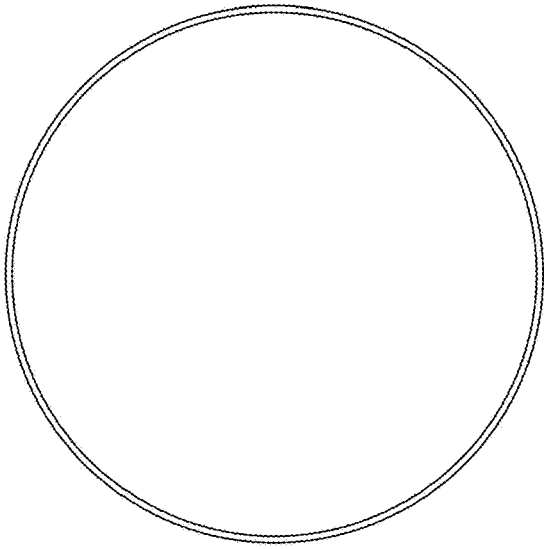
Figure 25:
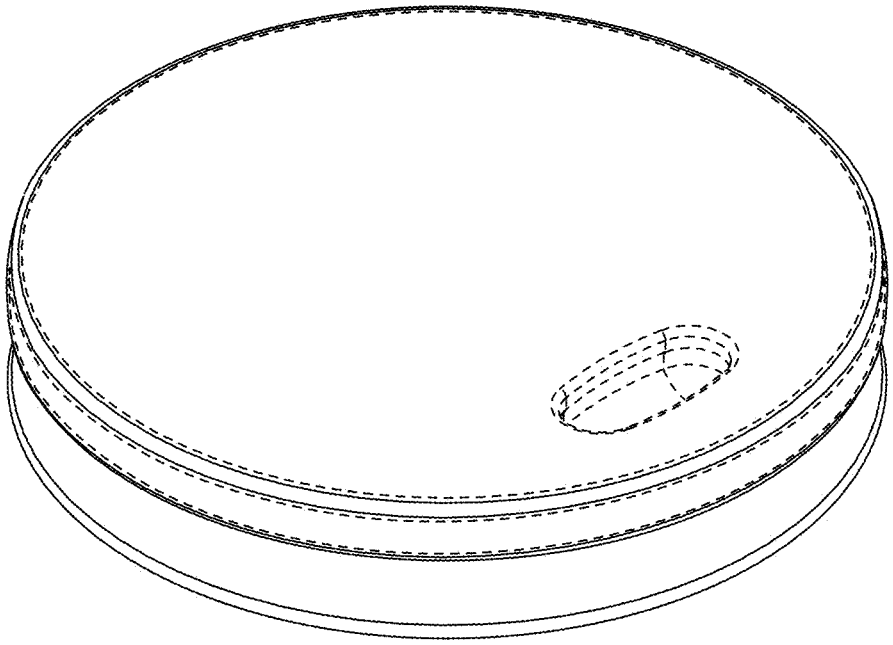
FIGS. 25-28 illustrates various ornamental appearances of another configuration of the storage apparatus.
Figure 26:
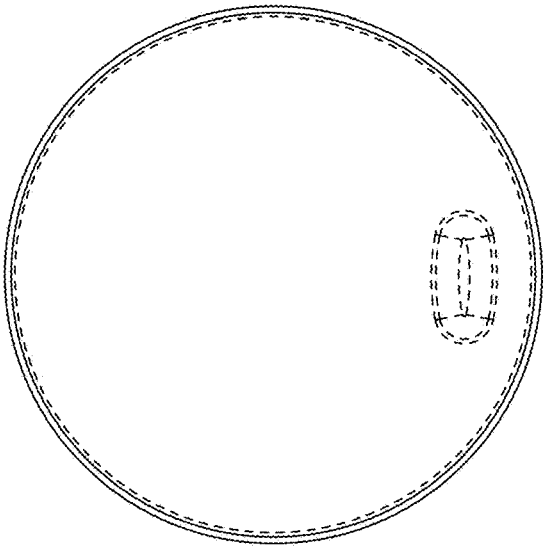
Figure 27:
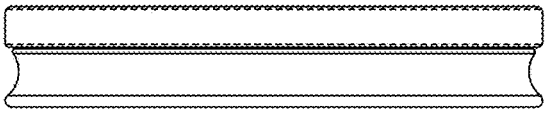
Figure 28:
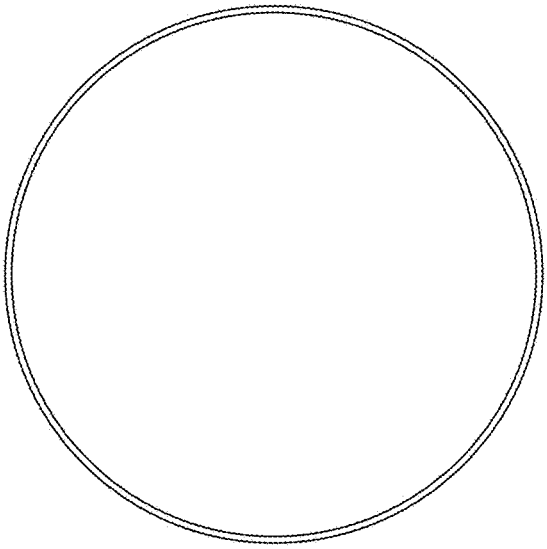

FIG. 17 illustrates a schematic of a user placing the storage apparatus in a bag, FIG. 18 illustrates a schematic of a user placing the storage apparatus in a briefcase, FIG. 19 illustrates a schematic of a user placing the storage apparatus in their pocket, and FIG. 20 illustrates a schematic of the storage apparatus 102 assembled with an accessory.

The storage apparatus 102 may be designed with portability as a key feature, allowing users to transport their objects throughout their daily activities easily. The apparatus' compact and streamlined form factor may enable it to fit comfortably in various personal carrying items such as pockets, handbags, backpacks, or briefcases without adding significant bulk or weight. To enhance portability, the storage apparatus 102 may include accessories such as a holding band wrapped around the device to secure it to a belt, wrist, or bag strap. Additional accessories may include a keychain attachment, a silicone protective sleeve, or a lanyard loop integrated into the design. These accessories may facilitate consistent adherence by ensuring that users can have their desired serving of objects readily available regardless of location or schedule. The circular shape and low profile of the storage apparatus 102 may contribute to its discreet nature, potentially allowing users to carry and access the same without drawing undue attention. Additionally, the secure magnetic coupling between the base 302 and cover 304 may help prevent accidental opening during transport, maintaining the integrity of the stored contents while on the move.

In an alternative configuration, the storage apparatus 102 may incorporate additional features to enhance functionality and user experience. For example, the storage apparatus 102 may include a built-in timer or alarm system to remind users when to access the pocket contents. Some versions of the storage apparatus 102 may incorporate a digital display to show the current time, date, or next scheduled amount. In other configurations of the storage apparatus 102, the pockets may be adjustable in size to accommodate objects of various shapes and sizes. Future iterations of the storage apparatus 102 may incorporate smart technology, such as Bluetooth connectivity, allowing the apparatus to sync with smartphone apps for tracking and reminders. Additionally, some configurations of the storage apparatus 102 may feature a child-resistant locking mechanism for added safety or a moisture-resistant seal to better protect the stored items from environmental factors. The storage apparatus 102 may also be designed with interchangeable covers or bases, allowing users to customize the appearance or functionality of the storage apparatus 102.

In some configurations, a method for storing a plurality of objects in a storage apparatus 102 is disclosed. The method, at the initial step, may include providing a base 302. The base 302 may include a base bottom 402 and an oppositely disposed base top 404. The base 302 may include a plurality of pockets 410 arranged in a circular pattern about a center of the base 302 on the base top 404. A base coupling assembly 406 may be adjoined to the center of the base 302 on the base top 404. The base coupling assembly 406 may include magnetic elements, mechanical fasteners, or a combination thereof, positioned at or near the center of the base 302. The base may be formed from materials such as aluminum, stainless steel, or other suitable metals or polymers that provide sufficient structural integrity and durability for the intended application.

In the next step, the method may further include providing a cover 304 that is removably adjoined to the base 302. The cover 304 may include a cover top 802 with an aperture 306 formed on it, and an oppositely disposed cover bottom 804. A cover coupling assembly 906 may be adjoined to the cover bottom 804. The cover coupling assembly 906 may be configured to engage with the base coupling assembly 406 to create a secure yet separable connection of the cover 304 with the base 302. The aperture 306 in the cover top 802 may be sized and shaped to allow objects to pass through when aligned with one of the pockets 410 in the base 302. The cover may be fabricated from similar materials as the base to ensure compatibility and consistent performance during use.

In the next step, the method may involve transitioning the cover 304 and the base 302 between a filling condition and an accessing condition. In the filling condition, the cover 304 may be decoupled from the base 302, allowing the plurality of pockets 410 to receive the plurality of objects. This configuration may facilitate easy loading of objects into the storage apparatus 102. In the accessing condition, the cover 304 may be rotatably adjoined to the base 302. The cover coupling assembly 906 may be coupled to the base coupling assembly 406, securing the cover 304 to the base 302 while still allowing rotational movement. The cover 304 may be rotated to align the aperture 306 with a desired pocket from the plurality of pockets 410, enabling access to an object from the desired pocket.

With reference to FIGS. 21-24, various ornamental appearances of a storage apparatus may include features as illustrated or may have various features not illustrated, modified, and/or removed. For example, the storage apparatus may include a cover and a base. The cover is coupled to the base.

With reference to FIGS. 25-28, various ornamental appearances of another configuration of the storage apparatus may include features as illustrated or may have various features not illustrated, modified, and/or removed. For example, the storage apparatus may include a cover and a base. The cover is coupled to the base.

Figure 29:
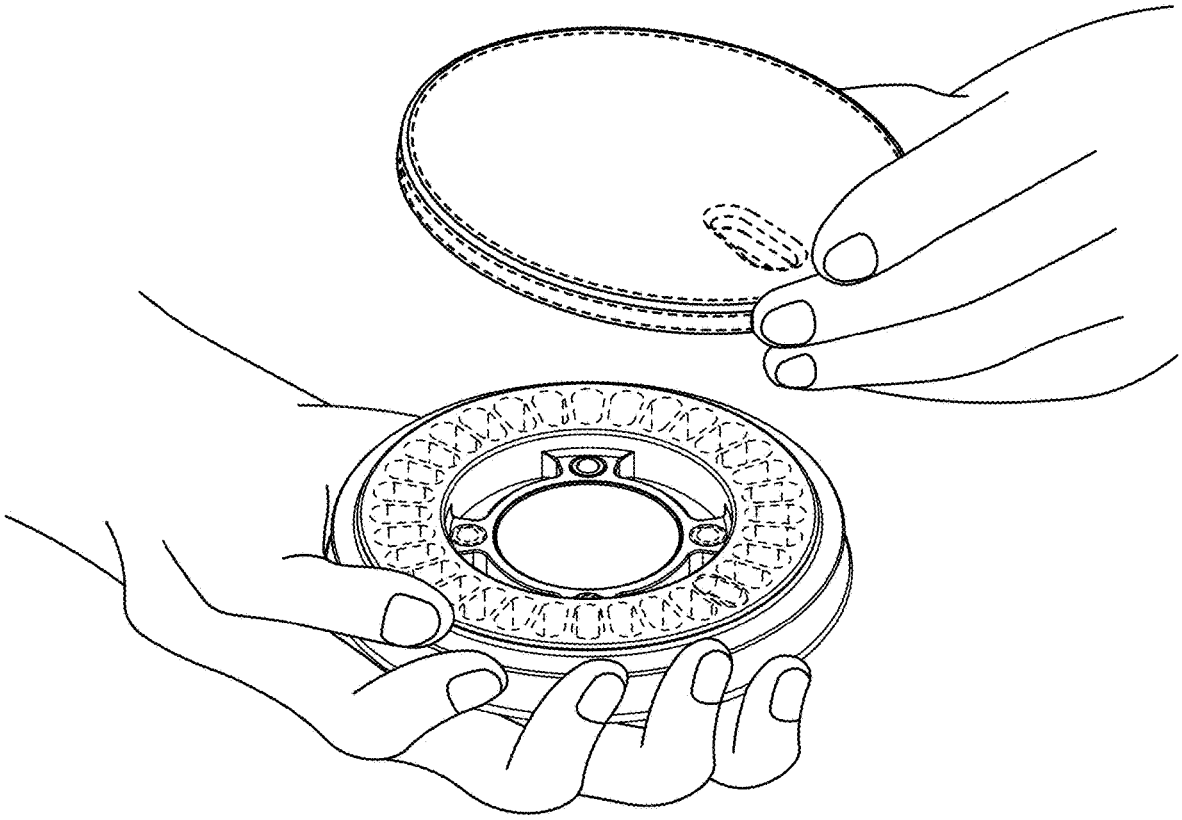
FIGS. 29-31 illustrates various ornamental appearances of an internal assembly of the storage apparatus.
Figure 30:
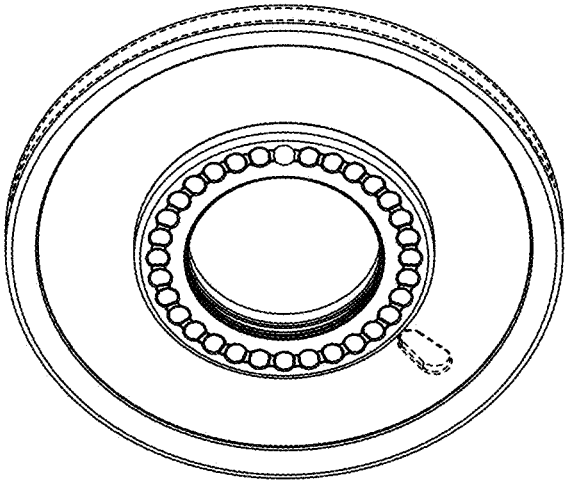
Figure 31:
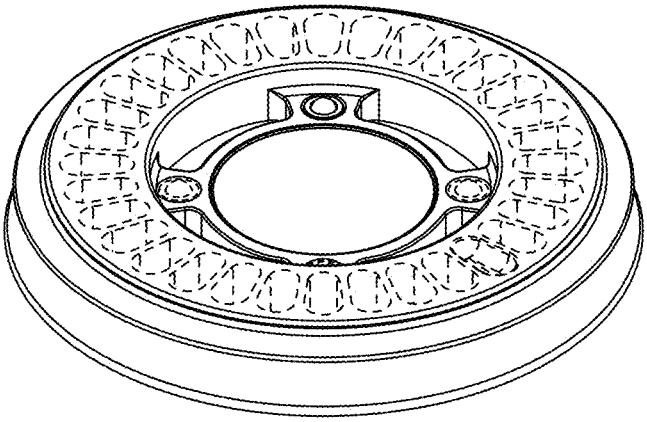

With reference to FIGS. 29-31, various ornamental appearances of an internal assembly of the storage apparatus may include features as illustrated or may have various features not illustrated, modified, and/or removed. For example, the storage apparatus may include a plurality of pockets, a base coupling feature, a base indexing feature, a cover coupling feature, and a cover indexing feature.

Figure 32:
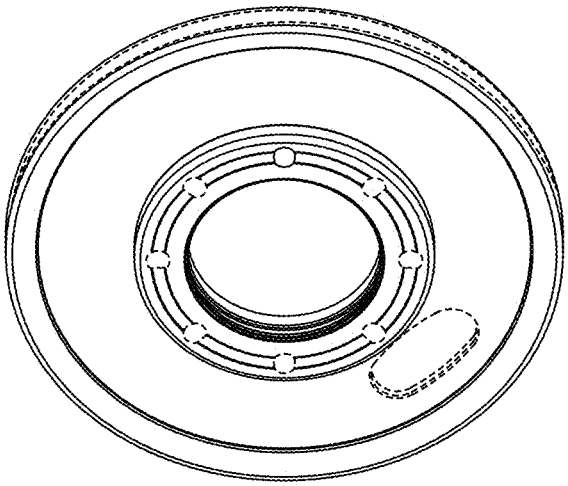
FIGS. 32-33 illustrates various ornamental appearances of an internal assembly of another configuration of the storage apparatus.
Figure 33:
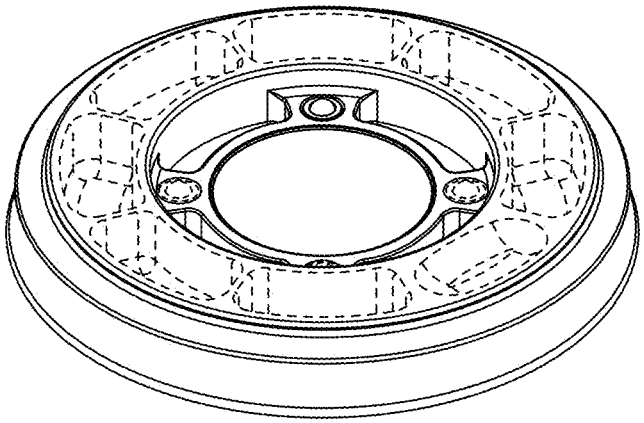

With reference to FIGS. 32-33, various ornamental appearances of internal assembly of another configuration of the storage apparatus may include features as illustrated or may have various features not illustrated, modified, and/or removed. For example, the storage apparatus may include a plurality of pockets, a base coupling feature, a base indexing feature, a cover coupling feature, and a cover indexing feature.

Figure 34:
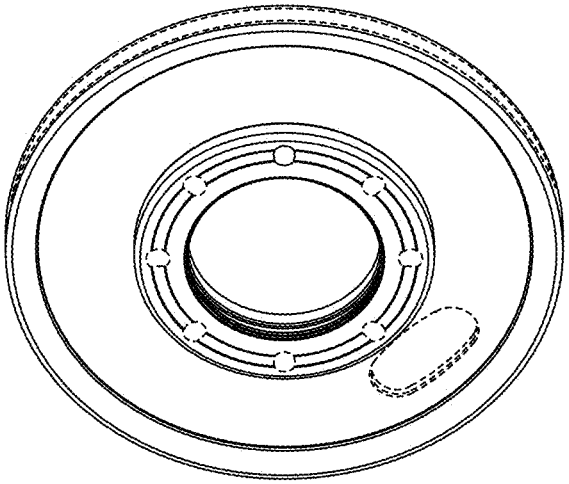
FIGS. 34-35 illustrates various ornamental appearances of an internal assembly of another configuration of the storage apparatus.
Figure 35:
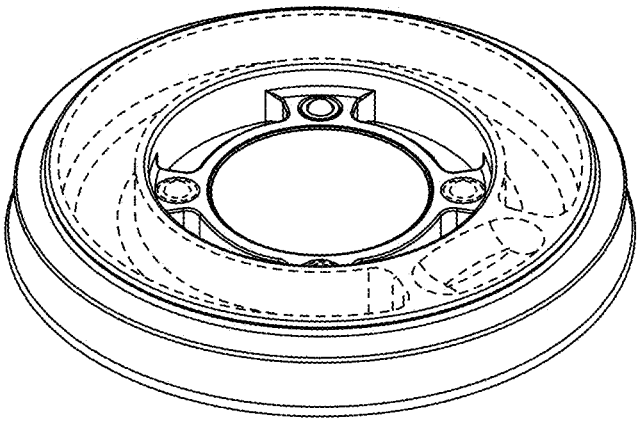
Figure 36:
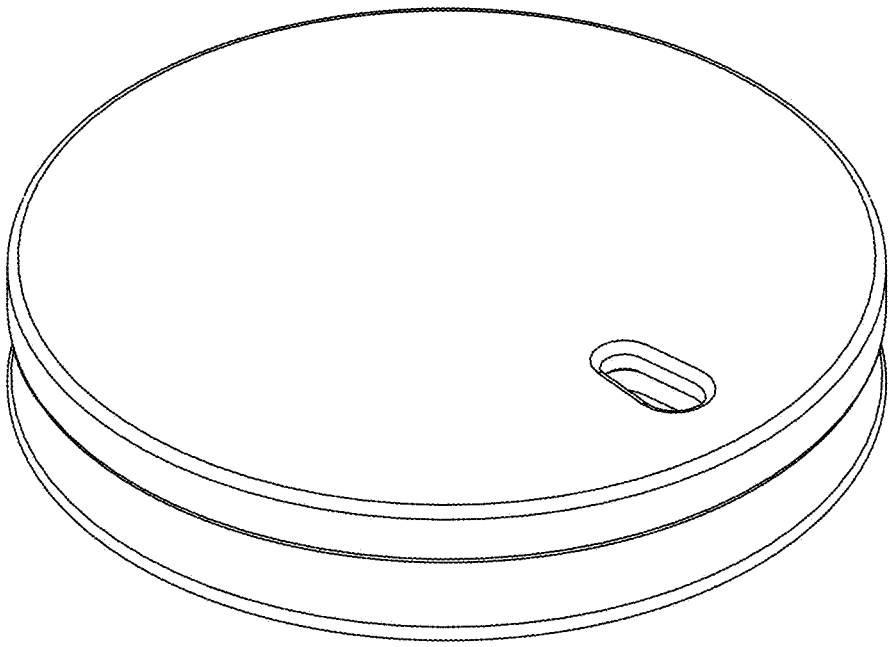
FIGS. 36-40 illustrates various ornamental appearances of an alternative configuration of the storage apparatus.
Figure 37:
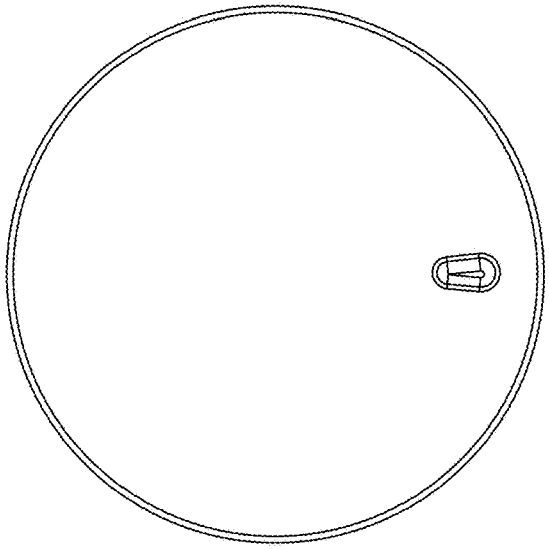
Figure 38:
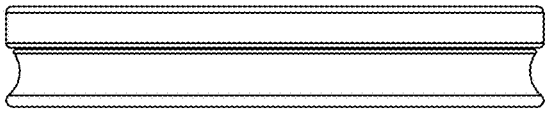
Figure 39:
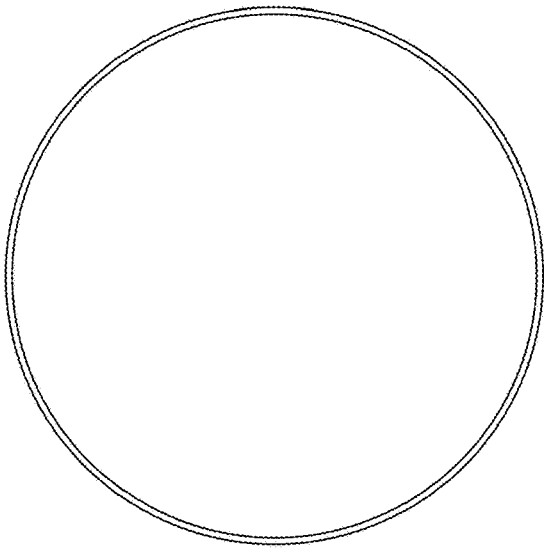
Figure 40:
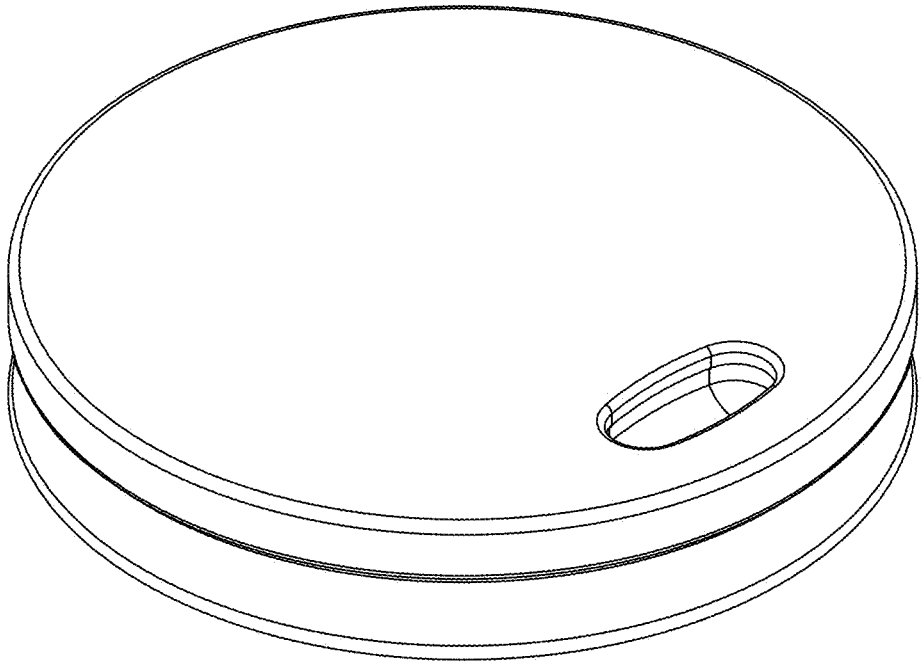

With reference to FIGS. 34-35, various ornamental appearances of the internal assembly of another configuration of the storage apparatus may include features as illustrated or may have various features not illustrated, modified, and/or removed. For example, the storage apparatus may include a plurality of pockets, a base coupling feature, a base indexing feature, a cover coupling feature, and a cover indexing feature.

With reference to FIGS. 36-40, various ornamental appearances of a storage apparatus may include features as illustrated or may have various features not illustrated, modified, and/or removed. For example, the storage apparatus may include a cover and a base. The cover is coupled to the base.

Figure 41:
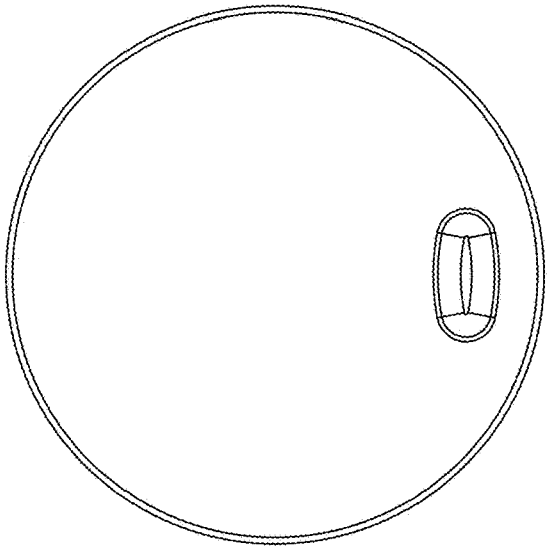
FIGS. 41-43 illustrates various ornamental appearances of another configuration of the storage apparatus.
Figure 42:
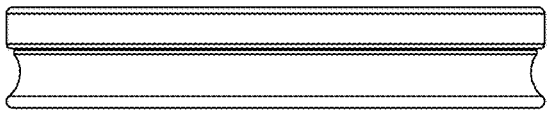
Figure 43:
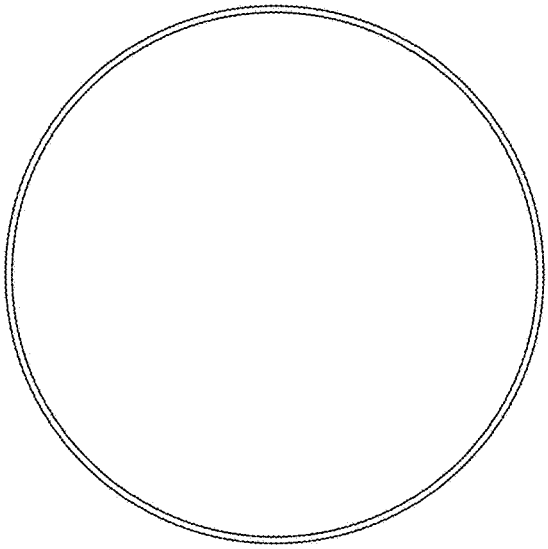

With reference to FIGS. 41-43, various ornamental appearances of another configuration of the storage apparatus may include features as illustrated or may have various features not illustrated, modified, and/or removed. For example, the storage apparatus may include a cover and a base. The cover is coupled to the base.

Figure 45:
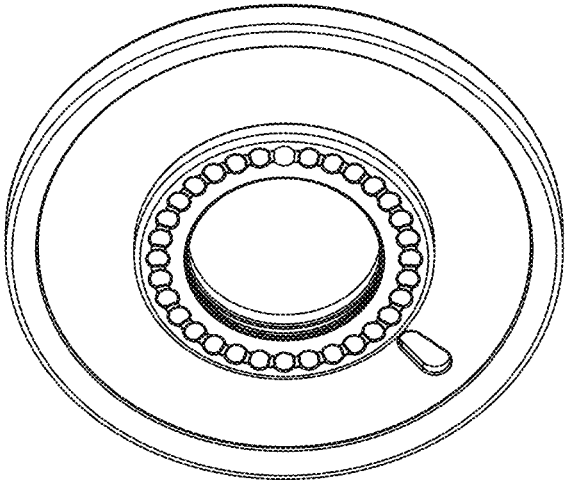
Figure 46:
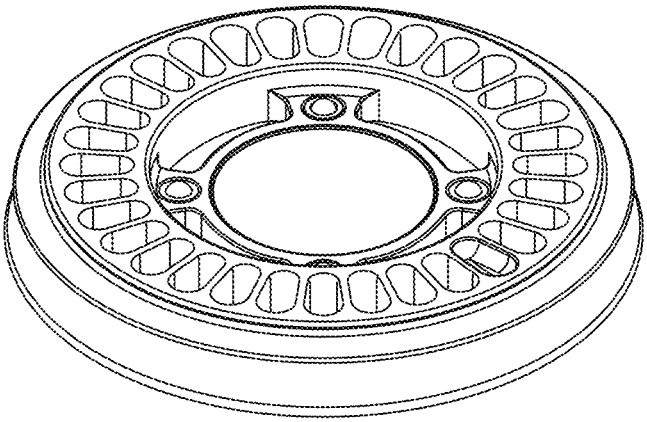

With reference to FIGS. 44-46, various ornamental appearances an internal assembly of the storage apparatus of FIGS. 36-40, may include features as illustrated or may have various features not illustrated, modified, and/or removed. For example, the storage apparatus may include a plurality of pockets, a base coupling feature, a base indexing feature, a cover coupling feature, and a cover indexing feature.

Figure 47:
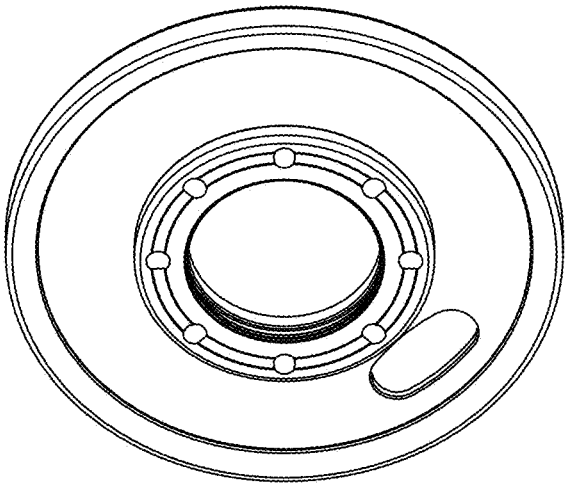
FIGS. 47-48 illustrates various ornamental appearances of an internal assembly of another configuration of the storage apparatus of FIGS. 41-43.
Figure 48:
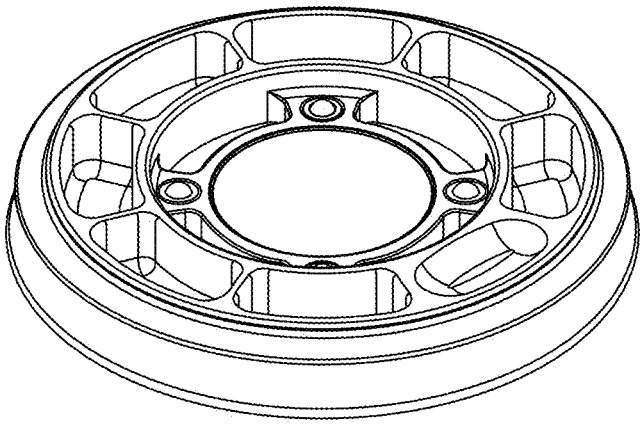

With reference to FIGS. 47-48, various ornamental appearances an internal assembly of the storage apparatus of FIGS. 41-43, may include features as illustrated or may have various features not illustrated, modified, and/or removed. For example, the storage apparatus may include a plurality of pockets, a base coupling feature, a base indexing feature, a cover coupling feature, and a cover indexing feature.

Figure 49:
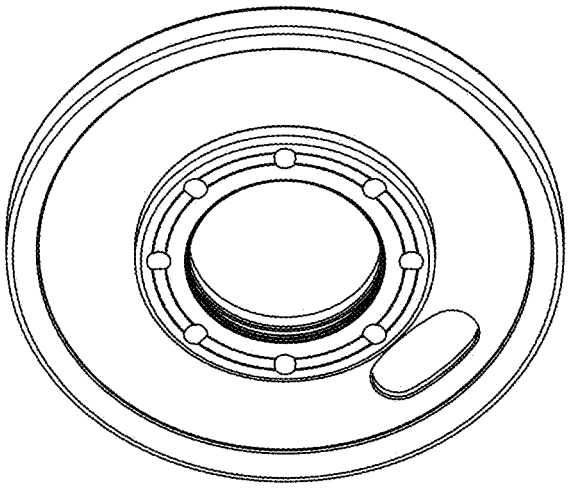
FIGS. 49-50 illustrates various ornamental appearances of an internal assembly of another configuration of the storage apparatus.
Figure 50:
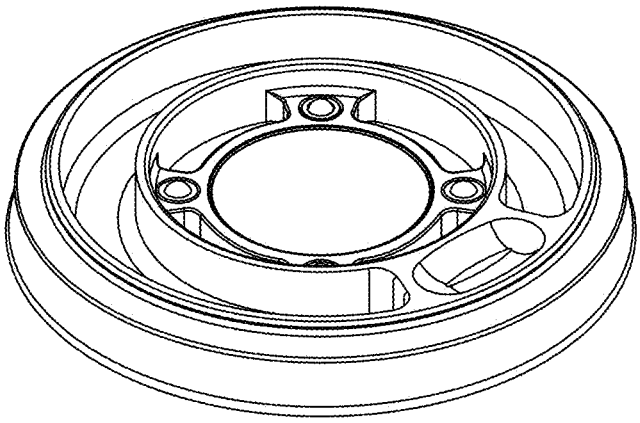

With reference to FIGS. 49-50, various ornamental appearances of the internal assembly of another configuration of the storage apparatus may include features as illustrated or may have various features not illustrated, modified, and/or removed. For example, the storage apparatus may include a plurality of pockets, a base coupling feature, a base indexing feature, a cover coupling feature, and a cover indexing feature.

Figure 51:
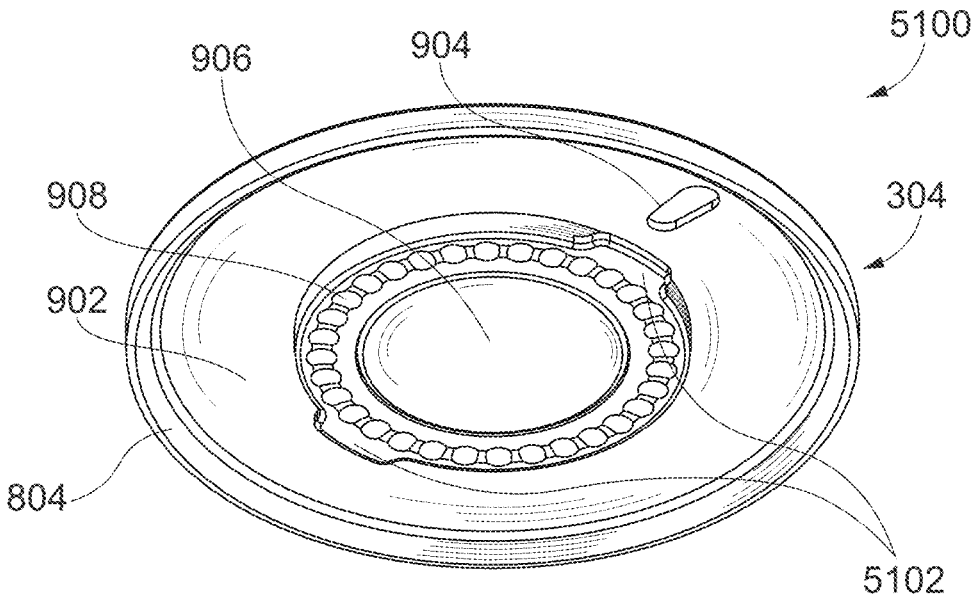
FIG. 51 illustrates a bottom perspective view of an alternative configuration of a cover.
Figure 52:
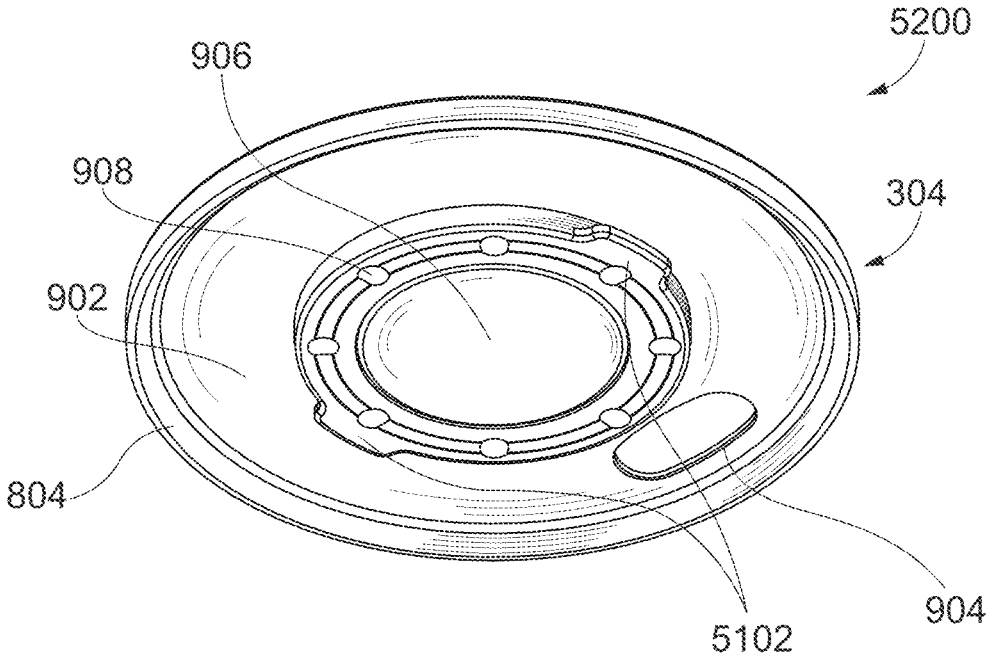
FIG. 52 illustrates a bottom perspective view of another alternative configuration of the cover.
Figure 53:
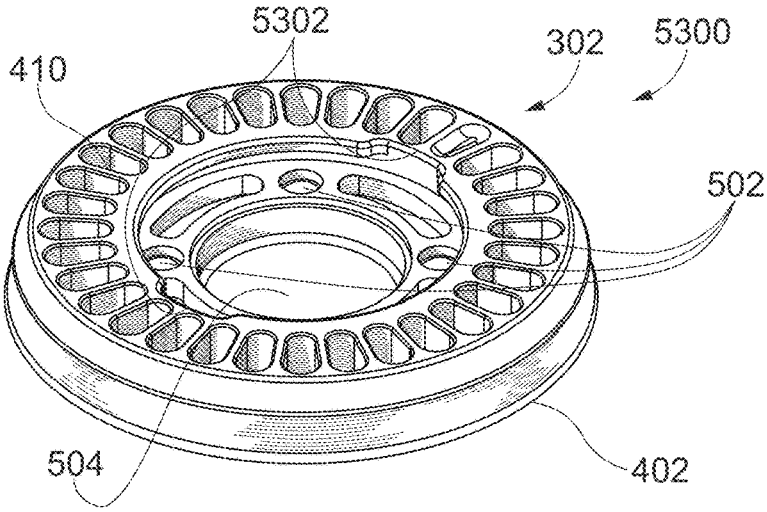
FIG. 53 illustrates a perspective view of an alternative configuration of a base.
Figure 54:
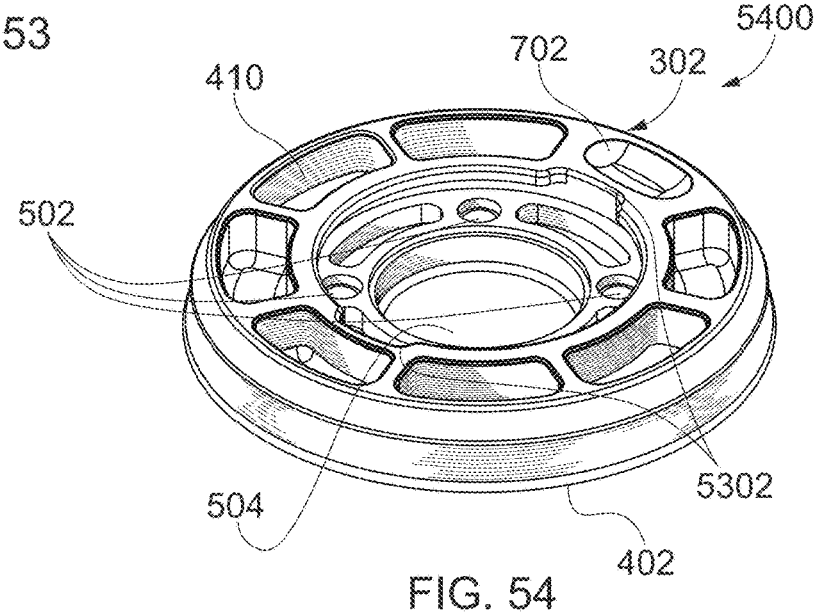
FIG. 54 illustrates a perspective view of another alternative configuration of the base.
Figure 55:
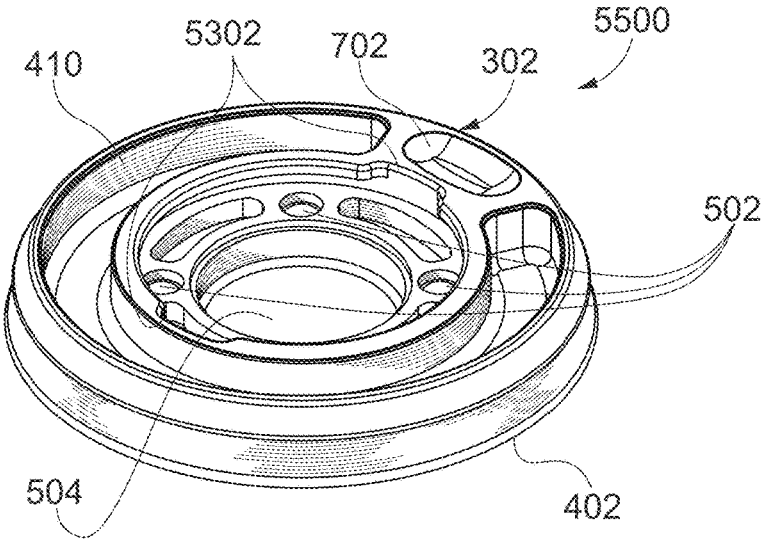
FIG. 55 illustrates a perspective view of another alternative configuration of the base.

FIG. 51 illustrates a bottom perspective view 5100 of an alternative configuration of a cover, FIG. 52 illustrates a bottom perspective view 5200 of another alternative configuration of the cover, FIG. 53 illustrates a perspective view 5300 of an alternative configuration of a base, FIG. 54 illustrates a perspective view 5400 of another alternative configuration of the base, and FIG. 55 illustrates a perspective view 5500 of another alternative configuration of the base.

In an alternative configuration, referring to FIGS. 51-55, the storage apparatus 102 may include a semi-locking internal feature to reduce the likelihood of accidental opening of the base 302 and cover 304. This feature may be incorporated into both the base 302 and cover 304 to provide enhanced security during transport and storage. The semi-locking mechanism may include at least one hook extrusion 5102 extending from the cover bottom 804. The at least one hook extrusion 5102 may be configured to travel within an overhang track 5302 that is formed in the base top 404. In some cases, the cover 304 may include a plurality of hook extrusions 5102, such as two hook extrusions 5102 positioned at predetermined locations around the circumference of the cover coupling housing 1006. The number of hook extrusions, may range from a single extrusion to multiple extrusions, and in some implementations, may include between 1 and 4 extrusions depending on the desired level of security and ease of use.

The base 302 may include corresponding overhang tracks 5302 configured to receive and guide the hook extrusions 5102 during assembly and disassembly. The overhang tracks 5302 may include at least one overhang track formed in the base top 404, with the overhang track having a profile that accommodates the hook extrusions 5102 while allowing rotational movement of the cover 304 relative to the base 302. The overhang track may include track cutouts or gaps positioned at specific locations to allow entry and exit of the hook extrusions during attachment and removal of the cover 304.

During assembly, the cover 304 may be oriented in a specific angular position relative to the base 302 to allow the hook extrusions 5102 to align with and pass through the overhang track 5302. Once the hook extrusions 5102 have entered the overhang tracks 5302, the cover 304 may be rotated to engage the semi-locking mechanism. In configurations with two hook extrusions, there may be two possible angular orientations for attachment and removal, positioned approximately 180 degrees apart from each other. The overhang tracks 5302 may be sized to provide a close clearance fit with the hook extrusions 5102, allowing for smooth entry and exit while maintaining secure engagement during normal operation.

This semi-locking feature may provide resistance to accidental opening and may also serve as a deterrent to unauthorized use by users unfamiliar with the apparatus's proper operation. In some cases, this feature may contribute to child-resistant properties, potentially qualifying the apparatus for child-safe or child-resistant certifications depending on applicable testing standards and regulatory requirements.

In an alternative configuration, the cover 304 may include a concavity formed on the cover top 802 that serves as an object collection and counting area, enhancing the user experience when filling the object storage apparatus 102 by helping contain objects poured from a container and preventing them from scattering, with the concavity potentially shaped to allow easy gathering of objects towards the center, featuring a smooth, polished surface to prevent sticking, incorporating subtle radial grooves or channels that guide objects towards the outlet 306, and possibly including a slight slope towards the outlet 306 to aid in object movement and reduce spillage, thereby providing a convenient, built-in solution for object handling that may be particularly beneficial for users with limited dexterity or those managing multiple types of objects.

Figure 56:
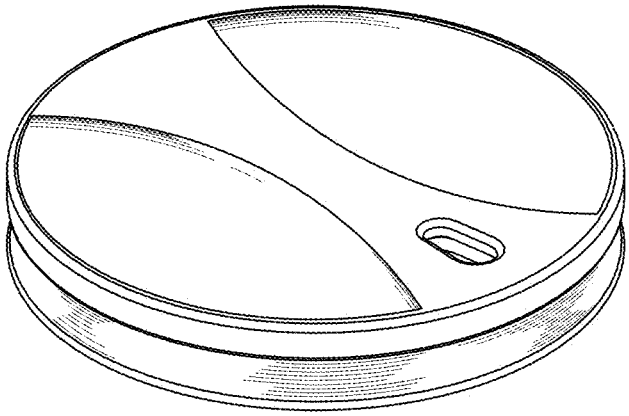
FIG. 56 illustrates a perspective view of an alternative configuration of the storage apparatus.
Figure 57:
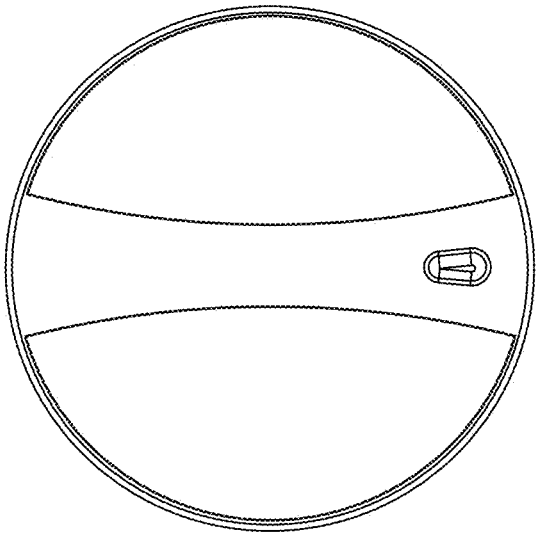
FIG. 57 illustrates a top view of the alternative configuration of the storage apparatus.
Figure 58:
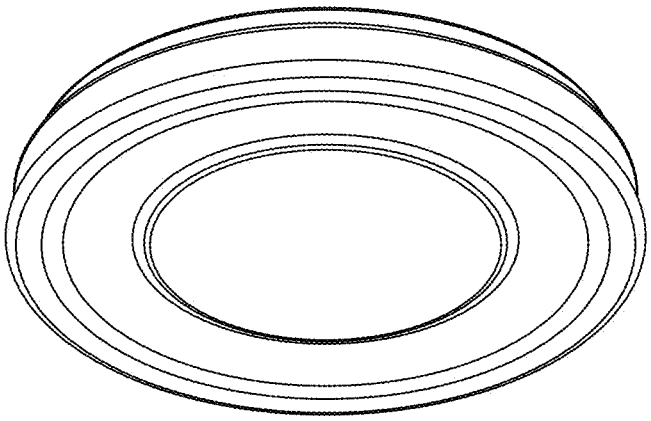
FIG. 58 illustrates a bottom view of an alternative configuration of the storage apparatus.

FIG. 56-58 illustrates a perspective view of an alternative configuration of the storage apparatus. The storage apparatus may include features as illustrated or may have various features not illustrated, modified, and/or removed. For example, the storage apparatus may include a cover and a base. The cover is coupled to the base. The cover may include an aesthetically formed top with an extended bottom.

The methods, systems, devices, graphs, and/or tables are illustrative examples, and configurations may omit, substitute, or add various procedures or components as appropriate. For instance, the methods may be reordered in alternative configurations, and/or various stages may be added, omitted, and/or combined. Alternatively, features described with respect to certain configurations may be in various alternative configurations. Different aspects and elements of the configurations may be combined similarly. Also, technology evolves; thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or more than one (i.e., to at least one) of the grammatical object of the article. By way of example, "an element" means one element or more than one element. "About" and/or "approximately" as used herein when referring to a measurable value such as an amount, a temporal duration, and the like encompass variations of ±20% or ±10%, ±5%, or ±0.1% from the specified value as such variations are appropriate in the context of the systems, devices, circuits, methods, and other implementations described herein. "Substantially," as used herein when referring to a measurable value such as an amount, a temporal duration, a physical attribute (such as frequency), and the like, also encompasses variations of ±20% or ±10%, ±5%, or ±0.1% from the specified value as such variations are appropriate in the context of the systems, devices, circuits, methods, and other implementations described herein.

As used herein, including in the claims, "and" as used in a list of items prefaced by "at least one of" or "one or more of" indicates that any combination of the listed items may be utilized. For example, a list of "at least one of A, B, and C" includes any of the combinations A, B, C, AB, AC, BC, and/or ABC (i.e., A, B, and C). Furthermore, to the extent more than one occurrence or use of the items A, B, or C is possible, multiple uses of A, B, and/or C may form part of the contemplated combinations. For example, a list of "at least one of A, B, and C" may include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed and that the appended claims are intended to be construed to include such variations except as limited by the prior art. While the principles of the disclosure have been provided in connection with specific apparatuses and methods, it is to be clearly understood that this description is made only by way of example and not as a limitation on the scope of the disclosure.

What is claimed is:

1. A storage apparatus to store a plurality of objects, the storage apparatus comprising:

a base comprising:

a base bottom;

a base top oppositely disposed to the base bottom;

a plurality of pockets arranged in a circular pattern about a center of the base on the base top; and a base coupling assembly adjoined to the center of the base on the base top;

a cover removably adjoined to the base, the cover comprising:

a cover top;

an aperture formed on the cover top;

a cover bottom oppositely disposed to the cover top; and a cover coupling assembly adjoining the cover bottom;

a filling condition, wherein:

the cover is decoupled from the base; and the plurality of pockets are configured to receive the plurality of objects; and an accessing condition, wherein:

the cover is rotatably adjoined to the base;

the cover coupling assembly is coupled to the base coupling assembly; and the cover is rotated to align the aperture to a desired pocket from the plurality of pockets to access an object from the desired pocket.

2. The storage apparatus of claim 1, wherein at least one of the cover coupling assembly or the base coupling assembly comprises:

a magnetic assembly comprising:

a magnet; and a wear plate to affix the magnet thereto.

3. The storage apparatus of claim 1, wherein:

the cover comprises:

a cover coupling housing formed on the cover bottom to accommodate the cover coupling assembly; and the base comprises:

a base coupling housing formed on the base bottom to accommodate the base coupling assembly.

4. The storage apparatus of claim 1 and further comprising:

a cover indexing feature formed on the cover bottom; and a base indexing feature adjoined to the base top and located between the plurality of pockets and the base coupling assembly, wherein the base indexing feature is formed corresponding to the cover indexing feature, wherein in the accessing condition:

the cover indexing feature interfaces the base indexing feature.

5. The storage apparatus of claim 4, wherein either of the cover indexing feature or the base indexing feature comprises:

a spring-loaded ball.

6. The storage apparatus of claim 5, wherein either the cover indexing feature or the base indexing feature comprises:

a ball detent configured to interface the spring-loaded ball to provide indexed rotation between the cover and the base.

7. The storage apparatus of claim 1 and further comprising:

at least one hook extrusion formed on the cover bottom; and at least one overhang track corresponding to the at least one hook extrusion, wherein the at least one overhang track is formed on the base bottom, wherein the at least one hook extrusion is engaged to the at least one overhang track to interlock the cover with the base.

8. The storage apparatus of claim 1 and further comprising:

a compressible gasket housing formed on the cover bottom; and a compressible gasket secured in the compressible gasket housing.

9. The storage apparatus of claim 8 and further comprising:

a first interlocking pattern formed on a perimeter of the compressible gasket;

a second interlocking pattern formed on the compressible gasket housing; and in the accessing condition:

the second interlocking pattern of the compressible gasket housing is configured to engage the first interlocking pattern of the compressible gasket to lock the compressible gasket with the cover.

10. The storage apparatus of claim 9 and further comprising:

an opening passage formed in the compressible gasket and aligned with the aperture of the cover.

11. A method of storing a plurality of objects in a storage apparatus, the method comprising:

providing a base, the base comprising:

a base bottom;

a base top oppositely disposed to the base bottom;

a plurality of pockets arranged in a circular pattern about a center of the base on the base top; and a base coupling assembly adjoined to the center of the base on the base top;

providing a cover, wherein the cover is removably adjoined to the base, the cover comprising:

a cover top;

an aperture formed on the cover top;

a cover bottom oppositely disposed to the cover top; and a cover coupling assembly adjoining the cover bottom; and transitioning the cover and the base between:

a filling condition, comprising:

decoupling the cover from the base; and receiving by the plurality of pockets, the plurality of objects; and an accessing condition, comprising:

rotatably adjoining the cover to the base;

coupling the cover coupling assembly to the base coupling assembly; and rotating the cover to align the aperture to a desired pocket from the plurality of pockets for accessing an object from the desired pocket.

12. The method of claim 11, wherein at least one of providing the cover or providing the base further comprises:

at least one of the cover coupling assembly or the base coupling assembly comprises:

a magnetic assembly comprising:

a magnet; and a wear plate to affix the magnet thereto.

13. The method of claim 11, wherein:

providing the cover comprises:

the cover coupling assembly comprising:

a cover coupling housing formed on the cover bottom to accommodate the cover coupling assembly; and the base coupling assembly comprising:

a base coupling housing formed on the base bottom to accommodate the base coupling assembly.

14. The method of claim 11 and further comprising:

providing a cover indexing feature, wherein the cover indexing feature is formed on the cover bottom; and providing a base indexing feature, wherein the base indexing feature is adjoined to the base top and located between the plurality of pockets and the base coupling assembly, wherein the base indexing feature is formed corresponding to the cover indexing feature, wherein in the accessing condition:

the cover indexing feature interfaces the base indexing feature.

15. The method of claim 14, wherein either of the cover indexing feature or the base indexing feature comprises a spring-loaded ball.

16. The method of claim 11 and further comprising:

providing at least one hook extrusion formed on the cover bottom; and providing at least one overhang track corresponding to the at least one hook extrusion, wherein the at least one overhang track is formed on the base bottom, wherein the at least one hook extrusion is engaged to the at least one overhang track to interlock the cover with the base.

17. The method of claim 11 and further comprising:

providing a compressible gasket housing formed on the cover bottom; and providing a compressible gasket, wherein the compressible gasket is secured in the compressible gasket housing.

18. The method of claim 17 and further comprising:

a first interlocking pattern formed on a perimeter of the compressible gasket;

a second interlocking pattern formed on the compressible gasket housing; and in the accessing condition:

the second interlocking pattern of the compressible gasket housing is configured to engage the first interlocking pattern of the compressible gasket to lock the compressible gasket with the cover.

19. An object storage assembly, comprising:

a first object storage apparatus, comprising:

a first base comprising:

a first base bottom;

a first base top oppositely disposed to the first base bottom;

a plurality of pockets arranged in a circular pattern about a first center of the first base on the first base top;

a first base coupling housing formed on the first center; and a first base coupling assembly accommodated in the first base coupling housing; and a first cover removably adjoined to the first base, the first cover comprising:

a first cover top;

a first cover bottom oppositely disposed to the first cover top;

a first cover coupling housing formed on a center of the first cover bottom; and a first cover coupling assembly accommodated in the first cover coupling housing;

a second object storage apparatus, comprising:

a second base comprising:

a second base bottom;

a second base top oppositely disposed to the first base bottom;

a plurality of pockets arranged in a circular pattern about a second center of the second base on the second base top;

a second base coupling housing formed on the second center; and a second base coupling assembly accommodated in the second base coupling housing; and a second cover removably adjoined to the second base, the second cover comprising:

a second cover top;

a second cover bottom oppositely disposed to the second cover top;

a second cover coupling housing formed on a center of the second cover bottom; and a second cover coupling assembly accommodated in the second cover coupling housing;

an accessing condition, wherein:

the first object storage apparatus is separated from the second object storage apparatus; and a traveling condition, wherein:

the first object storage apparatus is adjoined to the second object storage apparatus with:

the first base coupling assembly adjoined to the second cover coupling assembly, or the first cover coupling assembly adjoined to the second base coupling assembly.

20. The object storage assembly of claim 19, wherein each of the first object storage apparatus and the second object storage apparatus comprises:

a cover indexing feature formed on each of the first cover and the second cover; and a base indexing feature adjoined to each of the first base top and the second base top and located between the plurality of pockets in the first base coupling assembly and the second base coupling assembly.

21. The object storage assembly of claim 19, wherein each of the first cover and the second cover comprises:

a compressible gasket housing formed on each of the first cover bottom and the second cover bottom; and a compressible gasket secured in the compressible gasket housing.

22. The object storage assembly of claim 21, and further comprising:

a first interlocking pattern formed on a perimeter of the compressible gasket;

a second interlocking pattern formed on the compressible gasket housing; and in the accessing condition:

the second interlocking pattern of the compressible gasket housing is configured to engage the first interlocking pattern of the compressible gasket to interlock the compressible gasket with the first cover and the second cover.

* * * * *